US012583656B2

(12) United States Patent
Xue et al.

(10) Patent No.: US 12,583,656 B2
(45) Date of Patent: Mar. 24, 2026

(54) CONTAINER SYSTEM AND METHOD OF ASSEMBLY

(71) Applicant: The Procter & Gamble Company, Cincinnati, OH (US)

(72) Inventors: Shuwen Xue, GuangZhou (CN); Bo Gao, GuangZhou (CN)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 18/627,538

(22) Filed: Apr. 5, 2024

(65) Prior Publication Data

US 2024/0246737 A1 Jul. 25, 2024

Related U.S. Application Data

(63) Continuation of application No. PCT/CN2022/076557, filed on Feb. 17, 2022.

(51) Int. Cl.
*B65D 67/02* (2006.01)

(52) U.S. Cl.
CPC ..... *B65D 67/02* (2013.01); *B65D 2313/00* (2013.01)

(58) Field of Classification Search
CPC ..... B65D 5/427; B65D 21/0201; B65D 5/42; B65D 21/0212; B65D 5/2052; B65D 2571/00209; B65D 21/0204
USPC ..... 220/23.2, 23.4, 23.83, 4.24, 4.21; 229/125.39
See application file for complete search history.

(56) References Cited

U.S. PATENT DOCUMENTS 1,483,175 A * 2/1924 Guenther ..... B65D 5/643 229/125.39
2,561,979 A * 7/1951 George ..... B65D 5/68 229/125.21
2,802,614 A 8/1957 Richard
3,338,407 A * 8/1967 Carlson ..... B65D 5/42 229/101
3,473,690 A * 10/1969 De Cazenove ..... B65D 81/263 206/509
3,690,523 A * 9/1972 Link ..... B65D 5/4204 229/117.18

(Continued)

OTHER PUBLICATIONS

PCT Search Report and Written Opinion for PCT/CN2022/076557 dated Sep. 5, 2022 , 12 pages.

*Primary Examiner* — Steven A. Reynolds
*Assistant Examiner* — Prince Pal
(74) *Attorney, Agent, or Firm* — Matthew J. Spegele

(57) ABSTRACT

A container system including a first container having a first wall defining a first opening therethrough; a second container having a second wall defining a second opening therethrough; and a connecting member securing the second container to the first container. The second wall is disposed adjacent to the first wall, and the second opening is aligned with the first opening. The connecting member includes a narrow portion at least partially received within each of the first opening and the second opening; a first wide portion received within the first container, extending across the first opening, and engaging the first wall on opposing sides of the first opening; and a second wide portion disposed adjacent to the second wall, and extending across the second opening, such that the connecting member secures the second container to the first container.

17 Claims, 20 Drawing Sheets

(56) References Cited

U.S. PATENT DOCUMENTS 3,921,896 A * 11/1975 Ishimura ..... B65D 5/46088 229/117.12
4,245,773 A * 1/1981 Stollberg ..... B65D 5/6644 206/815
4,304,351 A * 12/1981 Stollberg ..... B65D 5/323 229/153
4,573,595 A * 3/1986 Mednis ..... B65D 21/0231 206/509
4,927,074 A * 5/1990 LaRue ..... B65D 5/68 229/125.21
4,971,242 A * 11/1990 LaNicca ..... B65D 5/427 229/120.32
5,029,710 A * 7/1991 Workman ..... B65D 21/0224 220/4.27
5,038,998 A * 8/1991 Morris ..... B65D 21/0212 229/122.22
5,497,939 A * 3/1996 Heiskell ..... B65D 11/1893 229/198.2
5,549,241 A * 8/1996 Correll ..... B65D 5/32 229/120.01
5,743,461 A * 4/1998 Timmins ..... B65D 5/643 206/386
6,357,652 B1 * 3/2002 Evans ..... B65D 55/06 493/383
6,431,436 B1 * 8/2002 Evers ..... B65D 5/006 206/821
7,658,316 B2 * 2/2010 Kawashita ..... B65D 5/4804 229/120.33
8,006,893 B2 * 8/2011 Burke ..... B65D 5/667 229/902
9,682,795 B1 * 6/2017 Frost ..... B65D 5/324
10,913,567 B2 * 2/2021 Nelson ..... B65D 5/002
11,401,057 B2 * 8/2022 Kiessner ..... B65D 5/2052
11,613,400 B1 * 3/2023 Hogan ..... B65D 5/6661 229/208
11,794,941 B2 * 10/2023 Zamir ..... B65D 71/14
11,932,464 B2 * 3/2024 Landis ..... B65D 5/2009
11,932,468 B2 * 3/2024 Hoefte ..... B65D 5/68
11,993,434 B2 * 5/2024 Hoefte ..... B65B 5/024
12,012,262 B2 * 6/2024 Zirollo ..... B65D 5/685
12,134,503 B2 * 11/2024 Hoefte ..... B65B 7/28
2009/0090647 A1 4/2009 Panchal
2011/0155728 A1 * 6/2011 Zajtai ..... B29C 45/1657 220/4.21
2013/0213842 A1 * 8/2013 Rentzel ..... B65D 5/427 206/395
2014/0061289 A1 * 3/2014 McKenna ..... B65D 5/0055 229/174
2014/0346218 A1 * 11/2014 Sublett ..... B65D 5/643 229/125.39
2015/0068945 A1 * 3/2015 Baker ..... B65D 5/0055 206/509
2016/0236847 A1 * 8/2016 Kisch ..... B65D 21/0201
2017/0166347 A1 * 6/2017 Couture ..... B31B 50/60
2018/0009564 A1 * 1/2018 Carman ..... B65D 5/427
2019/0112093 A1 * 4/2019 Delause ..... B65D 5/427
2020/0247574 A1 * 8/2020 Zamir ..... B65D 5/4295
2022/0081155 A1 * 3/2022 Hoefte ..... B65D 5/443
2024/0190624 A1 * 6/2024 Turner ..... B65D 15/22
2024/0246737 A1 * 7/2024 Xue ..... B65D 5/427

* cited by examiner

CONTAINER SYSTEM AND METHOD OF ASSEMBLY

FIELD OF THE INVENTION

The present disclosure relates to a container system and a method of assembling the container system.

BACKGROUND OF THE INVENTION

E-commerce, or use of internet to find and purchase goods, is becoming an increasingly popular way for consumers to shop. Continuous growth in e-commerce has resulted in dynamic requirements with regards to packaging and containers used therefor. For example, secondary products, such as free samples, gifts, and the like, may need to be shipped with primary products for promotional purposes. The primary products are typically packaged in their own primary containers, while the secondary products are typically packaged in their own secondary containers. Moreover, the secondary products may change based on the primary products and/or promotional offers applicable at a time of purchase.

Currently, a box-in-box approach is one approach used to ship the secondary products along with the primary products. In the box-in-box approach, the primary containers containing the primary products and the secondary containers containing the secondary products are packaged together in a large container and shipped to a consumer. However, such an approach may have several drawbacks. For example, the box-in-box approach may cause an increase in packaging size, resulting in an increase in transportation cost. The box-in-box approach may further require use of excess packaging materials, such as filler materials (e.g., bubble wraps, air pillows, air pack bags, etc.), to protect the primary container and the secondary container from damage. Such packaging materials may be non-recyclable, and excess use thereof may be detrimental to environmental sustainability.

There remains a need to provide a container system that is suitable for the dynamic requirements of e-commerce, cost effective, easy to assemble, environmentally friendly, and that reduces requirement of the packaging materials.

SUMMARY OF THE INVENTION

The invention provides a container system comprising: a first container comprising a first wall defining at least one first opening therethrough; at least one second container comprising a second wall disposed adjacent to the first wall, the second wall defining at least one second opening therethrough, wherein the at least one second opening is aligned with the at least one first opening; and at least one connecting member at least partially received within the at least one first opening and the at least one second opening, the at least one connecting member comprising a narrow portion extending between a first end and a second end opposing the first end, a first wide portion disposed at the first end of the narrow portion, and a second wide portion disposed at the second end of the narrow portion, wherein a width of the narrow portion is less than a width of each of the first wide portion and the second wide portion, wherein the width of the first wide portion is greater than a maximum width of the at least one first opening, and wherein the width of the second wide portion is greater than a maximum width of the at least one second opening; wherein: the narrow portion is at least partially received within each of the at least one first opening and the at least one second opening; the first wide portion is received within the first container, the first wide portion extending across the at least one first opening and engaging the first wall on opposing sides of the at least one first opening; and the second wide portion is disposed adjacent to the second wall and extends across the at least one second opening, such that the at least one connecting member secures the at least one second container to the first container.

The invention further provides a method of assembling a container system, the method comprising: disposing a second wall of a second container adjacent to a first wall of a first container; aligning a first opening of the first wall with a second opening of the second wall; disposing a connecting member in a first orientation with respect to the first opening and the second opening; inserting the connecting member through the first opening and the second opening in the first orientation; and rotating the connecting member from the first orientation to a second orientation, such that at least a portion of the connecting member is misaligned with the first opening and the second opening.

The invention further provides a container system comprising: a first container comprising a first wall defining a pair of first openings therethrough; a second container comprising a second wall disposed adjacent to the first wall, the second wall defining a pair of second openings therethrough, wherein each second opening from the pair of second openings is aligned with a corresponding first opening from the pair of first openings; a pair of connecting members, wherein each connecting member from the pair of connecting members is at least partially received with a corresponding first opening from the pair of first openings and a corresponding second opening from the pair of second openings, each connecting member comprising a narrow portion extending between a first end and a second end opposing the first end, a first wide portion disposed at the first end of the narrow portion, and a second wide portion disposed at the second end of the narrow portion, wherein a width of the narrow portion of each connecting member is less than a width of each of the first wide portion and the second wide portion, wherein the width of the first wide portion of each connecting member is greater than a maximum width of the corresponding first opening, and wherein the width of the second wide portion of each connecting member is greater than a maximum width of the corresponding second opening; and a securing member disposed on the second wall and comprising a longitudinal portion extending at least partially along the second wall between opposing ends, a pair of end extensions extending from opposing ends of the longitudinal portion, and an intermediate extension extending from the longitudinal portion between the pair of end extensions, such that the intermediate extension, the pair of end extensions, and the longitudinal portion together define a pair of notches therebetween, wherein each of the pair of notches is aligned with the narrow portion of a corresponding connecting member from the pair of connecting members; wherein: the narrow portion is at least partially received within each of the corresponding first opening and the corresponding second opening; the first wide portion is received within the first container, the first wide portion extending across the corresponding first opening and engaging the first wall on opposing sides of the corresponding first opening; the second wide portion is disposed adjacent to the second wall and extends across the corresponding second opening; each of the pair of notches at least partially receives therein the narrow portion of the corresponding connecting member; each of the pair of end extensions is at least partially received between the second wide portion of the corresponding connecting member and the second wall, each of the pair of end extensions engaging the narrow portion and the second wide portion of the corresponding connecting member and the second wall; and the intermediate extension at least partially extends between the pair of connecting members and is at least partially received between the second wide portion of each connecting member and the second wall, the intermediate extension engaging the narrow portion and the second wide portion of each connecting member and the second wall, such that the pair of connecting members and the securing member secure the second container to the first container.

BRIEF DESCRIPTION OF THE DRAWINGS

While the specification concludes with claims particularly pointing out and distinctly claiming the subject matter that is regarded as the present invention, it is believed that the invention will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings are necessarily to scale.

DETAILED DESCRIPTION OF THE INVENTION

Figure 1:
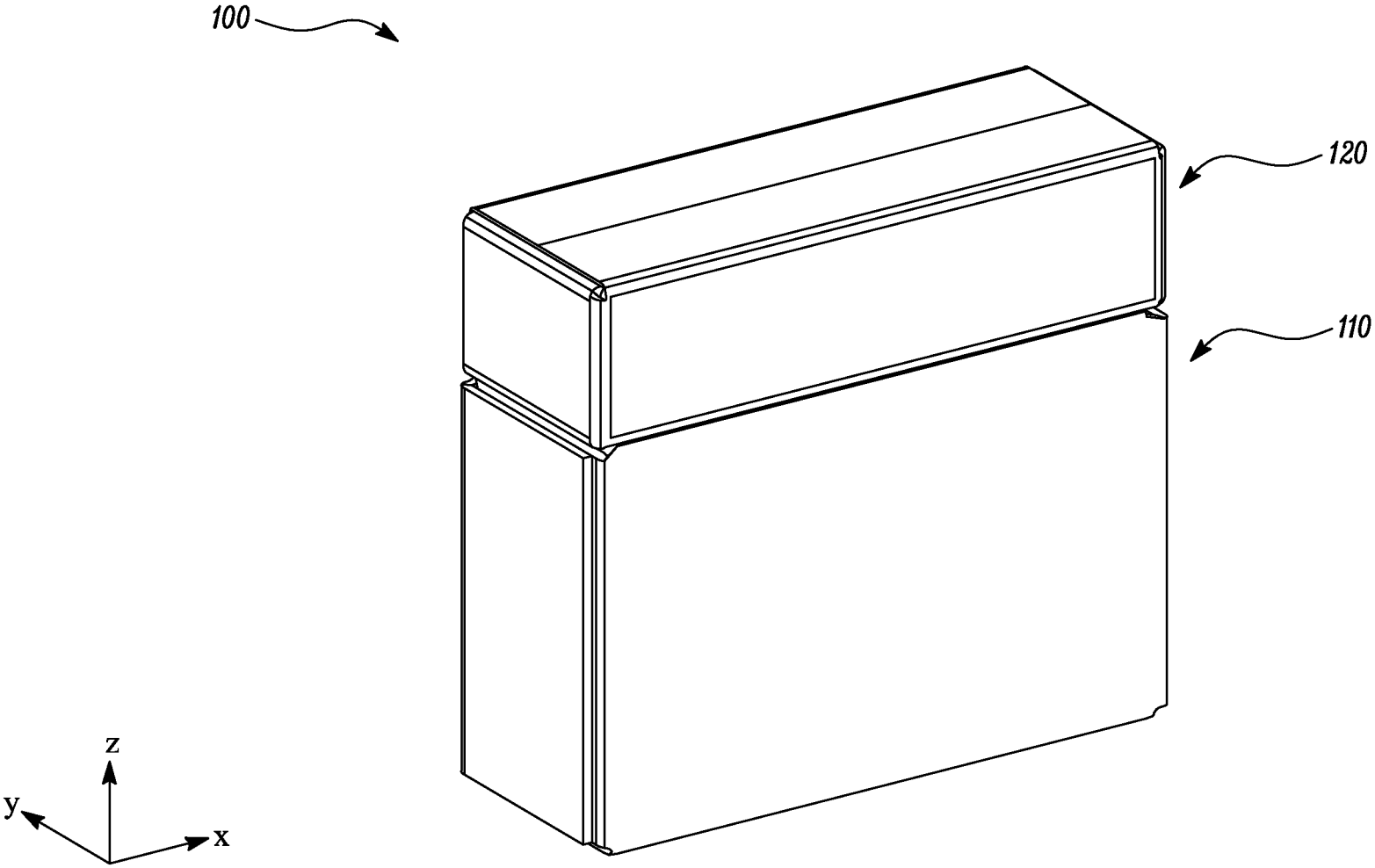
FIG. 1 is a perspective view of a container system according to the invention.

The invention relates to a container system. The container system comprises a first container comprising a first wall defining at least one first opening therethrough. The container system further comprises at least one second container comprising a second wall disposed adjacent to the first wall. The second wall defines at least one second opening therethrough. The at least one second opening is aligned with the at least one first opening. The container system further comprises at least one connecting member at least partially received within the at least one first opening and the at least one second opening. The at least one connecting member comprises a narrow portion extending between a first end and a second end opposing the first end, a first wide portion disposed at the first end of the narrow portion, and a second wide portion disposed at the second end of the narrow portion. A width of the narrow portion is less than a width of each of the first wide portion and the second wide portion. The width of the first wide portion is greater than a maximum width of the at least one first opening. The width of the second wide portion is greater than a maximum width of the at least one second opening. The narrow portion is at least partially received within each of the at least one first opening and the at least one second opening. The first wide portion is received within the first container. The first wide portion extends across the at least one first opening and engages the first wall on opposing sides of the at least one first opening. The second wide portion is disposed adjacent to the second wall and extends across the at least one second opening, such that the at least one connecting member secures the at least one second container to the first container.

The first container may contain one or more primary products therein, and the at least one second container may contain one or more secondary products therein. The first container may be tailored based on the one or more primary products, and the at least one second container may be tailored based on the one or more secondary products.

The container system may provide a modular design suitable for packaging different types of products, i.e., the primary and secondary products. The container system may therefore be suitable for dynamic requirements of e-commerce. Furthermore, the container system may provide a higher packing efficiency as compared to a box-in-box approach. This may reduce a volume occupied during shipping, thereby reducing a shipping cost of the container system. The first container and/or the at least one second container may be standardized to facilitate automation in assembly lines or may change based on application requirements.

The container system may utilize less material (e.g., packaging materials that are non-recyclable, cardboard, etc.) as compared to the box-in-box approach. For example, the container system may reduce up to 50% paperboard utilization or more, along with up to 25% or more total material cost reduction, as compared to the box-in-box approach. Moreover, the container system may be made partly or wholly of recyclable materials (e.g., corrugated cardboard). Therefore, the container system may be economical and environmentally friendly.

The container system may further provide improved protection to products contained within the first container and the at least one second container, while reducing packaging material required for protection. For example, the container system may prevent collision between the one or more primary products contained within the first container and the one or more secondary products contained within the at least one second container.

Components of the container system, such as the at least one connecting member, may be configured based on the one or more primary products to be contained within the first container and the one or more secondary products to be contained within the at least one second container. Specifically, dimensions of the at least one connecting member may be selected based upon a total weight of the one or more primary products and the one or more secondary products. For example, a weight density (or thickness) of the at least one connecting member may be proportional to the total weight. The container system may therefore pass packaging tests, such as ISTA 6A developed by Amazon.com, Inc., of Seattle, Washington. As a result, the container system may further provide improved shippability.

The container system may also have an aesthetically pleasing appearance while being easy to assemble/disassemble. The at least one second container may be easily attached to and detached from the first container via the connecting member. This may improve customer experience and satisfaction. The container system may obviate the need for conventional attachment methods, such as adhesive tape, glue plastic wrap, or other materials and methods. Such fasteners are typically not easy to apply and remove, and may not provide an aesthetically pleasing appearance.

The at least one connecting member may be at least partially insertable through the at least one second opening and the at least one first opening in a first orientation, such that the narrow portion may be at least partially received within each of the at least one first opening and the at least one second opening, the first wide portion may be received within the first container adjacent to the first wall, and the second wide portion may be disposed adjacent to the second wall. Upon insertion, the at least one connecting member may be rotatable from the first orientation to a second orientation, such that the at least one connecting member may secure the at least one second container to the first container when in the second orientation. Therefore, the container system may provide a simple mechanism (rotation of the at least one connecting member from the first orientation to the second orientation) to secure the at least one second container to the first container. The at least one second container may be removed or released from the first container by rotating the at least one connecting member from the second orientation to the first orientation.

The at least one connecting member may define a connection axis extending along the narrow portion. The at least one connecting member may be rotatable about the connection axis between the first orientation and the second orientation.

Each of the at least one first opening and the at least one second opening may comprise a central opening portion and a pair of elongate opening portions extending from opposing sides of the central opening portion. The central opening portion may define the maximum width of each of the at least one first opening and the at least one second opening. A width of each of the pair of elongate opening portions may be less than the maximum width of the central opening portion. The width of the narrow portion may be less than or equal to the maximum width of the central opening portion, such that the at least one connecting member may be rotatable relative to the central opening portion between the first orientation and the second orientation. The width of the narrow portion may be greater than the width of each of the pair of elongate opening portions, such that the narrow portion may be secured within the central opening portion.

The central opening portion may be generally circular, such that the maximum width corresponds to a diameter of the central opening portion. Further, each of the pair of elongate opening portions may be generally rectangular with a rounded end. The central opening portion being generally circular may facilitate rotation of the at least one connecting member when received therein.

Each of the at least one first opening and the at least one second opening may define an opening axis along its length. In the first orientation, each of the first wide portion and the second wide portion may be aligned with the opening axis, such that the first wide portion may be insertable through each of the at least one first opening and the at least one second opening. In the second orientation, at least a portion of each of the first wide portion and at least a portion of the second wide portion may be misaligned with the opening axis. Therefore, due to the misalignment, the at least one connecting member may secure the at least one second container to the first container.

The first wall may define a longitudinal axis along its length. The opening axis may be inclined to the longitudinal axis by an opening angle. The opening angle may be any suitable angle, i.e., the opening angle may be from 0 degrees (i.e., substantially parallel to the longitudinal axis) to 90 degrees (i.e., substantially perpendicular to the longitudinal axis). The opening angle may preferably be less than 90 degrees (for example, about 45 degrees) to allow for a reduced dimension of the first wall along an axis perpendicular to the longitudinal axis.

In the first orientation, each of the first wide portion and the second wide portion may be substantially parallel to the opening axis. In the second orientation, each of the first wide portion and the second wide portion may be inclined to the opening axis by an inclination angle. The inclination angle may be any angle that allows at least a portion of the first wide portion and/or at least a portion of the second wide portion to be misaligned with the opening axis. Preferably, the inclination angle is between about 15 degrees and 90 degrees. However, the inclination angle may be between about 30 degrees and about 60 degrees, or about 45 degrees.

The first wall may comprise a first major surface facing the second wall and a second major surface opposite to the first major surface. The first wall may comprise at least one recess disposed proximal to the at least one first opening and extending at least partially from the second major surface to the first major surface. The at least one connecting member may further comprise at least one end projection extending from the first wide portion towards the second wide portion.

The at least one end projection may be at least partially received in the at least one recess, thereby preventing rotation of the first wide portion relative to the first wall. The at least one recess may comprise a pair of recesses disposed on the opposing sides of the at least one first opening. The at least one end projection may comprise a pair of end projections extending from corresponding opposing ends of the first wide portion towards the second wide portion. Each of the pair of end projections may be at least partially received in a corresponding recess from the pair of recesses.

The pair of end projections received in the pair of recesses may better prevent rotation of the first wide portion relative to the first wall.

The container system may further comprise a securing member comprising at least one notch. The securing member may be at least partially received between the second wide portion and the second wall. The narrow portion may be at least partially received within the at least one notch. The securing member may engage the narrow portion, the second wide portion, and the second wall. The securing member may prevent movement of the at least one connecting member and may secure the at least one connecting member in the second orientation. The securing member may have suitable dimensions, such that the securing member is itself secured at a fixed position relative to the at least one connecting member during transportation. It may be noted that dimensions of the securing member may further be based on the total weight of the one or more primary products and the one or more secondary products.

The first container may further comprise at least one first closing member configured to close the at least one first opening. The at least one first closing member may be, for example, removably attached to the first wall of the first container. The at least one first closing member may be removed from the at least one first opening prior to attaching the at least one second container with the first container.

Moreover, the at least one second container may further comprise at least one second closing member configured to close the at least one second opening. The at least one second closing member may be, for example, removably attached to the second wall of the at least one second container. The at least one second closing member may be removed from the at least one second opening prior to attaching the at least one second container with the first container.

The at least one first closing member and the at least one second closing member may reduce or prevent entry of undesired contaminants, insects, and the like into the first container and the at least one second container, respectively, when they are not attached or secured to each other. This can be advantageous if the first container or the at least one second container are shipped or stored independently from each other.

The first container may be in a closed configuration prior to disposing the second wall of the at least one second container adjacent to the first wall of the first container. This may allow different second containers containing different products to be quickly attached to the first container based on requirements. Therefore, the container system may provide an agile mechanism to quickly attach different second containers to the first container as per application requirements.

Definitions:

As used herein, the term "at least one" is used to designate any number or range of numbers that is technically reasonable in the given context. The term "at least one" may, inter alia, be understood as one, two, three, four, five, etc. The term "at least one" may refer to a singular component or a plurality of components.

As used herein, "foldably connected" refers to any two components that are connected so as to facilitate folding and/or rotation of either component with respect to the other component. Suitable folding features such as a crease line may be provided between the two components to facilitate folding and/or rotation relative to each other.

As used herein, the term "closed configuration" refers to a configuration of a container in which any product disposed within the container is prevented from escaping the container. A container in the closed configuration may not necessarily be hermetically sealed.

As used herein, the term "assembled state" refers to a state of a container in which the container defines a closed compartment. In the assembled state, the container may fully enclose a product packaged in the closed compartment. The container may be suitable for shipping in the assembled state. The assembled state may correspond to the closed configuration of the container.

As used herein, the term "disassembled state" refers to a state of a container in which the container does not define a closed compartment. The container may be assembled into the assembled state from the disassembled state. One example of the disassembled state comprises a foldable blank in an unfolded state. The foldable blank may form the container upon assembly from the unfolded state.

Referring now to the Figures, FIG. 1 illustrates a perspective view of a container system 100 according to the invention. The container system 100 may define mutually orthogonal x, y, and z-axes. The x-axis may be defined along a length of the container system 100, while the y-axis may be defined along a breadth of the container system 100. The z-axis may be defined along a height of the container system 100. A width of any component of the container system 100, unless otherwise mentioned, is measured in the x-y plane.

The container system 100 comprises a first container 110 and at least one second container 120 secured to the first container 110. The container system 100 illustrated in FIG. 1 comprises a single second container 120 secured to the first container 110. However, the container system 100 may comprise a plurality of second containers 120 secured to the first container 110.

The first container 110 and/or the at least one second container 120 according to invention may be of various shapes, for example, a generally cuboid shape. The first container 110 and/or the at least one second container 120 may have rounded edges and/or corners, and for purposes herein are considered generally cuboid. However, the first container 110 and/or the at least one second container 120 may have any suitable three-dimensional shape, as per application requirements.

The at least one second container 120 illustrated in FIG. 1 is smaller than the first container 110. However, the at least one second container 120 may have any suitable size. Specifically, the at least one second container 120 may be smaller than, equal to, or greater than the first container 110. It may be noted that size and dimensions of the first container 110 and the at least one second container 120 may be selected based on one or more products to be packaged therein.

Figure 2A:
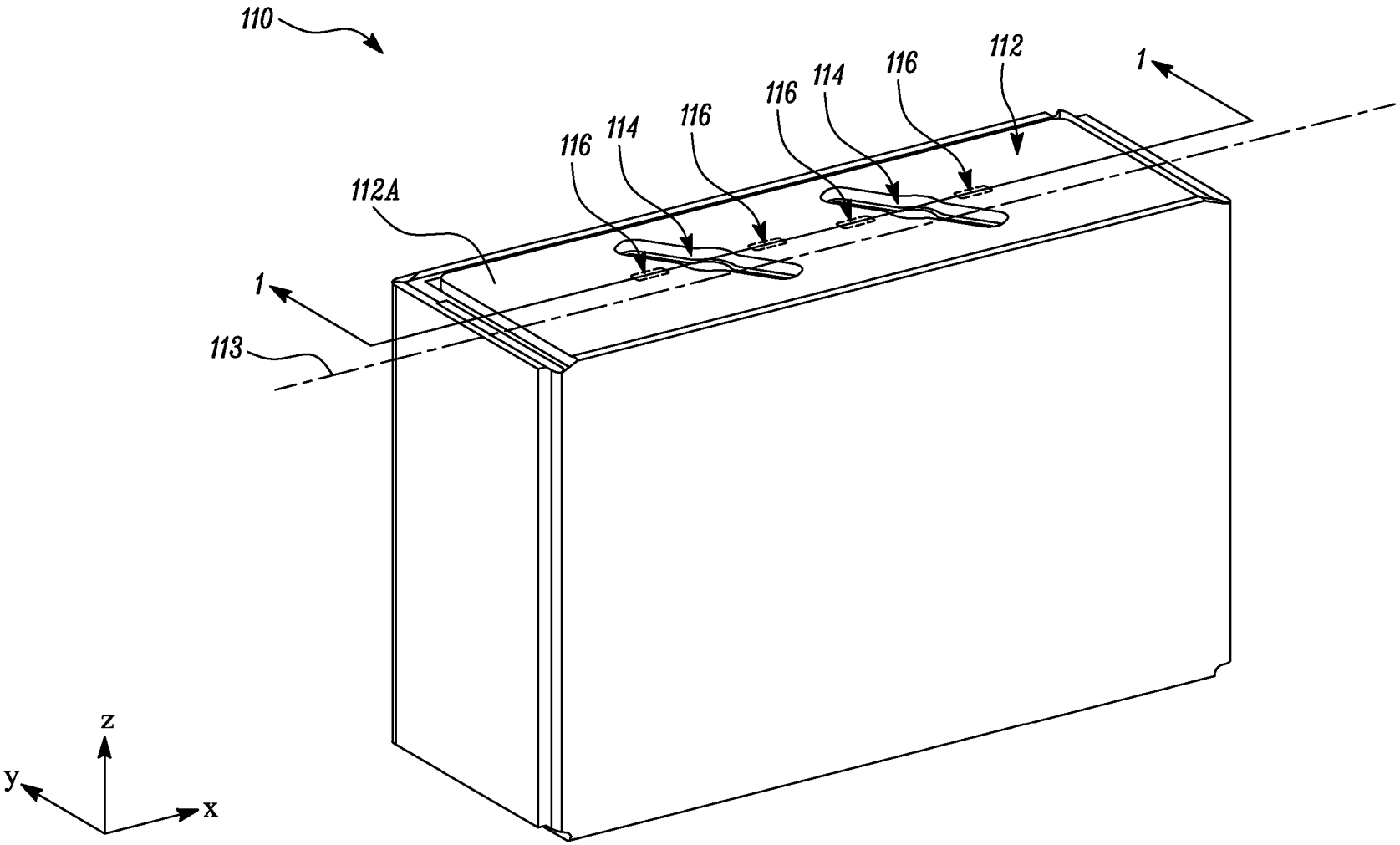
FIG. 2A is a perspective view of a first container of the container system of FIG. 1.
Figure 2B:
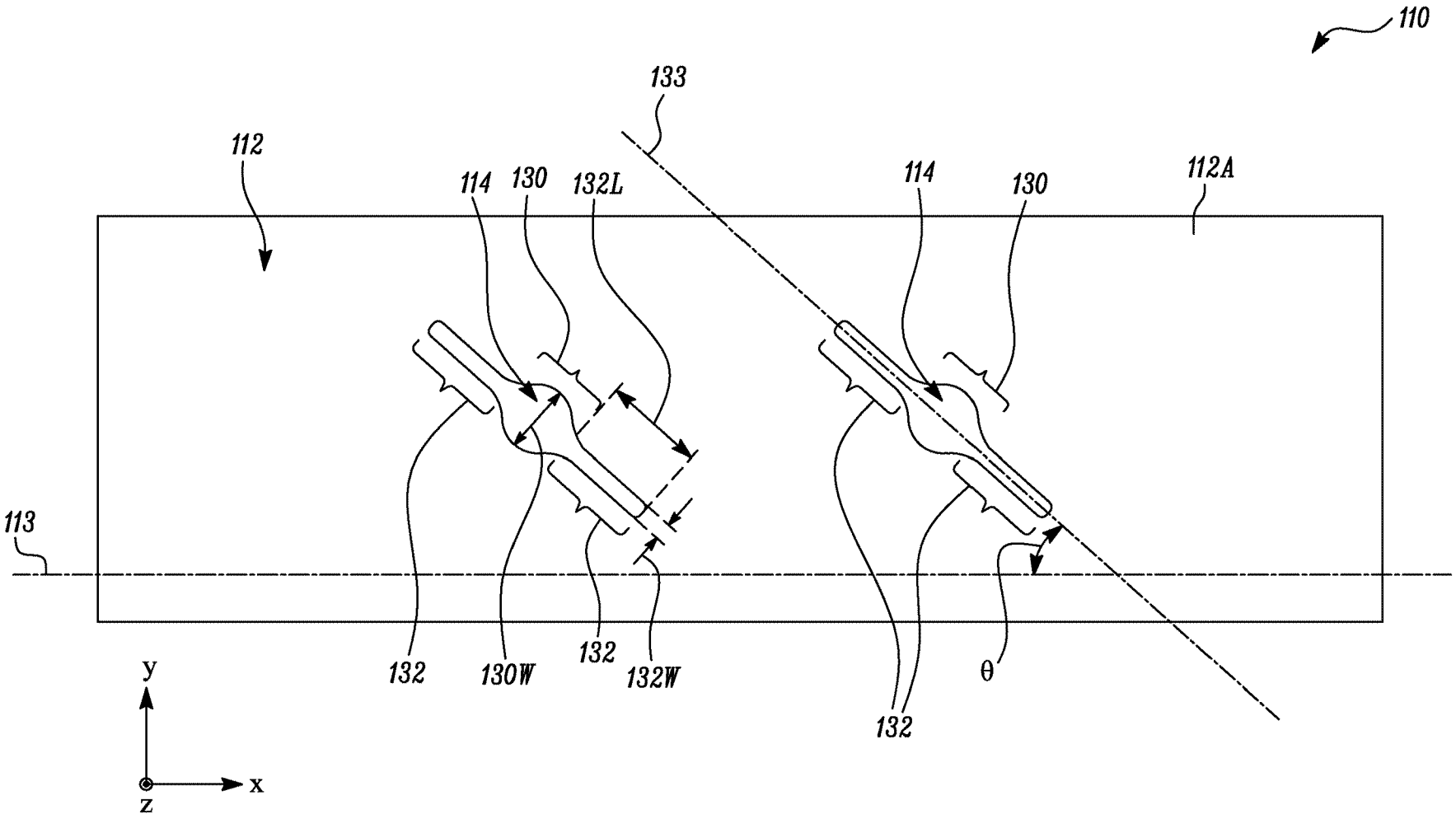
FIG. 2B is a top view of the first container of FIG. 2A.
Figure 2C:
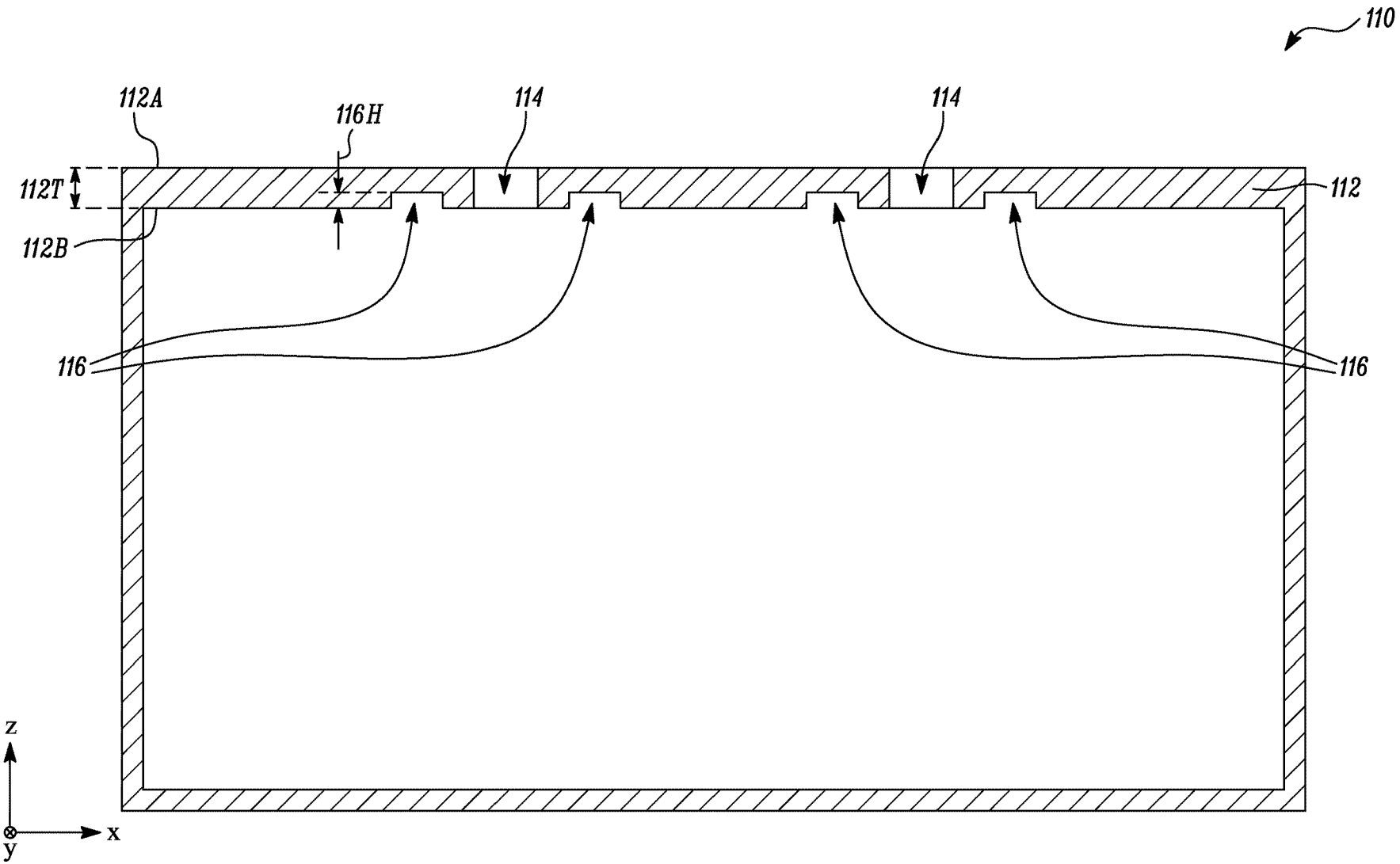
FIG. 2C is a sectional view of the first container taken along a line 1-1 of FIG. 2A.

FIGS. 2A to 2C illustrate the first container 110 according to the invention. Specifically, FIG. 2A illustrates a perspective view of the first container 110, FIG. 2B illustrates a top view of the first container 110, and FIG. 2C illustrates a sectional view of the first container 110 taken along a line 1-1 of FIG. 2A. The x, y, and z-axes are also illustrated in FIGS. 2A to 2C.

Referring to FIGS. 2A to 2C, the first container 110 comprises a first wall 112 defining at least one first opening 114 therethrough. The first wall 112 illustrated in FIGS. 2A to 2C is a top wall of the first container 110. However, the first wall 112 may be one or more of a top wall, a bottom wall, a front wall, a rear wall, and a side wall of the first container 110. The first wall 112 may refer to one or more walls of the first container 110 that define the at least one first opening 114 therethrough.

The first wall 112 may define a single first opening 114, or a plurality of first openings 114 spaced apart from each other. In other words, the at least one first opening 114 may comprise the single first opening 114, or the plurality of first openings 114 spaced apart from each other. The plurality of first openings 114 may be similar to, or different from each other in shape and dimensions. The first wall 112 illustrated in FIGS. 2A to 2C defines a pair of first openings 114 therethrough. The pair of first openings 114 may be spaced apart from each other.

The at least one first opening 114 may comprise a slot-like shape. As illustrated in FIG. 2B, the at least one first opening 114 may comprise a central opening portion 130 and a pair of elongate opening portions 132 extending from opposing sides of the central opening portion 130. The central opening portion 130 may define a maximum width 130W of the at least one first opening 114.

The central opening portion 130 illustrated in FIG. 2B is generally circular, such that the maximum width 130W corresponds to a diameter of the central opening portion 130. However, the central opening portion 130 may have any suitable shape, such as generally rectangular, polygonal, and the like. Moreover, each of the pair of elongate opening portions 132 illustrated in FIG. 2B is generally rectangular with a rounded end. However, each of the pair of elongate opening portions 132 may have any suitable shape, such as generally triangular, generally rectangular, polygonal, and the like.

Each of the pair of elongate opening portions 132 may comprise a length 132L and a width 132W. The length 132L of each of the pair of elongate opening portions 132 may be greater than the width 132W thereof. In some examples, the length 132L may be greater than or equal to two times the width 132W. Moreover, the width 132W of each of the pair of elongate opening portions 132 may be less than the maximum width 130W of the central opening portion 130. Further, the length 132L of each of the pair of elongate opening portions 132 may be greater than the maximum width 130W of the central opening portion 130.

The first wall 112 may further define a longitudinal axis 113 along its length. The longitudinal axis 113 may be substantially parallel to the x-axis. Further, the at least one first opening 114 may define an opening axis 133 along its length. The opening axis 133 may be disposed in the x-y plane. For example, as illustrated in FIG. 2B, the at least one first opening 114 may define the opening axis 133 extending substantially along the pair of elongate opening portions 132. The opening axis 133 may be inclined to the longitudinal axis 113 by an opening angle θ. The opening angle θ may be any suitable angle, i.e., the opening angle θ may be from 0 degrees (i.e., substantially parallel to the longitudinal axis 113) to 90 degrees (i.e., substantially perpendicular to the longitudinal axis 113). As illustrated in FIG. 2B, the opening angle θ may be about 45 degrees. The opening angle θ is preferably less than 90 degrees (for example, about 45 degrees) to allow for a reduced dimension of the first wall 112 along an axis (y-axis in FIG. 2B) perpendicular to the longitudinal axis 113.

The first wall 112 may comprise a first major surface 112A and a second major surface 112B (illustrated in FIG. 2C) opposite to the first major surface 112A. Each of the first major surface 112A and the second major surface 112B may be disposed substantially in the x-y plane. The first wall 112 may define a thickness 112T between the first major surface 112A and the second major surface 112B substantially along the z-axis. The thickness 112T may correspond to a maximum thickness of the first wall 112. As discussed above, the first wall 112 defines the at least one first opening 114 therethrough. That is, the at least one first opening 114 may fully extend from the first major surface 112A to the second major surface 112B.

The first wall 112 may further comprise at least one recess 116 (best illustrated in FIG. 2C) disposed proximal to the at least one first opening 114. The at least one recess 116 is indicated by hidden or dashed lines in FIG. 2A. The at least one recess 116 may extend at least partially from the second major surface 112B to the first major surface 112A. As illustrated in FIG. 2C, the at least one recess 116 may partially extend from the second major surface 112B to the first major surface 112A. Alternatively, the at least one recess 116 may fully extend between the second major surface 112B and the first major surface 112A. The at least one recess 116 may comprise a height 116H substantially along the z-axis.

The first wall 112 illustrated in FIG. 2C comprises a pair of recesses 116 disposed on opposing sides of the at least one first opening 114. In other words, the at least one recess 116 may comprise the pair of recesses 116 disposed on the opposing sides of the at least one first opening 114. Specifically, the first wall 112 illustrated in FIG. 2C comprises two pairs of recesses 116 corresponding to the pair of first openings 114. Each pair of recesses 116 from the two pairs of recesses 116 is disposed on the opposing sides of a corresponding first opening 114 from the pair of first openings 114. Further, each recess 116 may extend partially from the second major surface 112B to the first major surface 112A. Therefore, the height 116H of each recess 116 along the z-axis may be less than the thickness 112T of the first wall 112. In some examples, the height 116H of each recess 116 may be from 20% to 90% of the thickness 112T of the first wall 112. However, it may be noted that the at least one recess 116 is optional and may be omitted from the first container 110.

Figure 3:
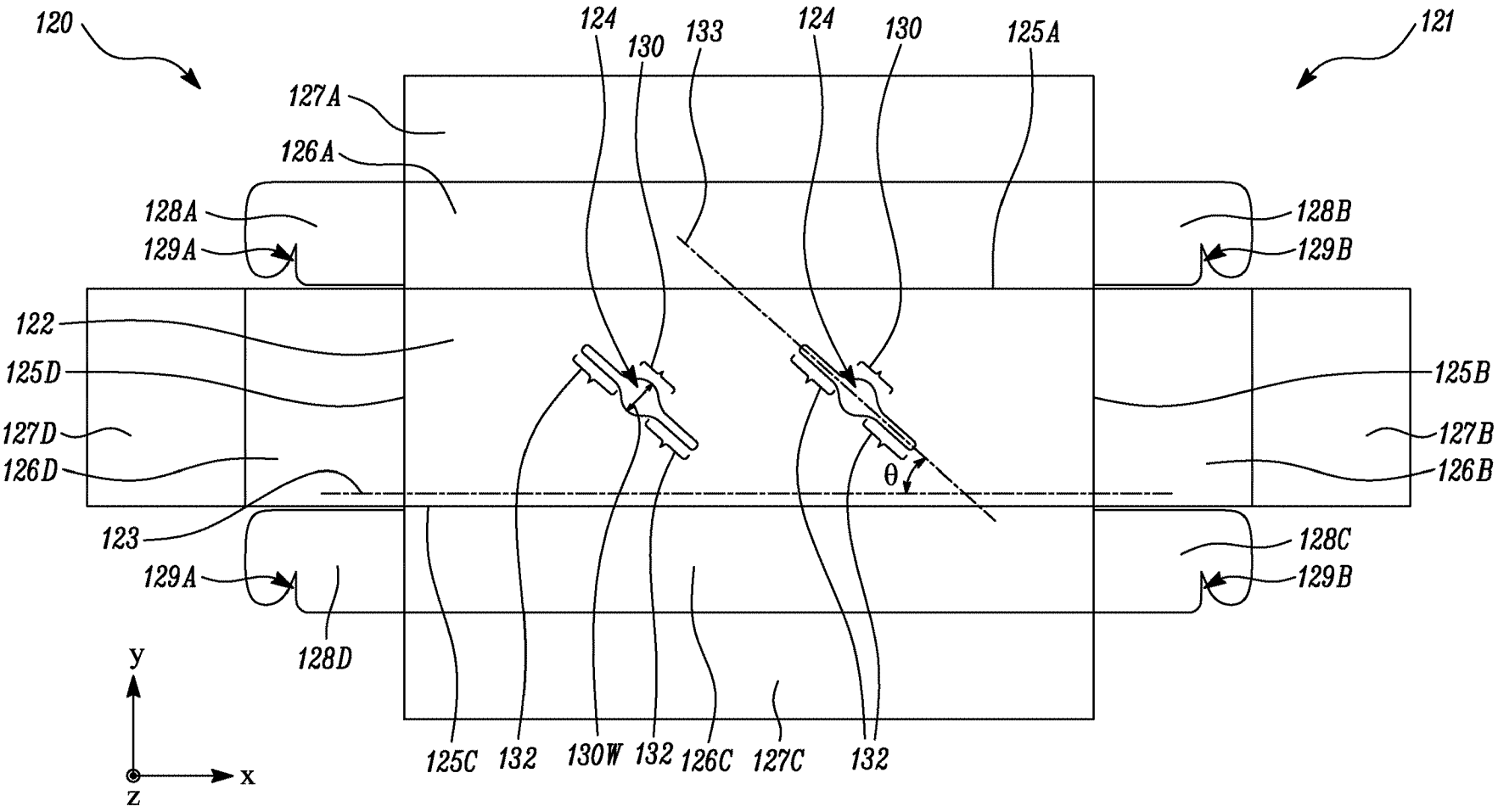
FIG. 3 is a plan view of a foldable blank that may be assembled into a second container of the container system of FIG. 1 according to the invention.

FIG. 3 illustrates a plan view of a foldable blank 121 that may be assembled into the at least one second container 120. In other words, FIG. 3 illustrates a plan view of the at least one second container 120 in a disassembled state. The at least one second container 120 is illustrated in an assembled state in FIG. 1. The at least one second container 120 in the disassembled state may be interchangeably referred to herein as the foldable blank 121.

The at least one second container 120 comprises a second wall 122 defining at least one second opening 124 therethrough. The at least one second opening 124 may correspond to the at least one first opening 114 of the first container 110 (illustrated in FIG. 2A to 2C). The second wall 122 illustrated in FIG. 3 is a bottom wall of the at least one second container 120 (when assembled from the foldable blank 121). However, the second wall 122 may be any one of a bottom wall, a front wall, a rear wall, and a side wall of the at least one second container 120. The second wall 122 may refer to any wall of the at least one second container 120 that defines the at least one second opening 124 therethrough.

The second wall 122 may define a single second opening 124, or a plurality of second openings 124 spaced apart from each other. In other words, the at least one second opening 124 may comprise the single second opening 124, or the plurality of second openings 124 spaced apart from each other. The plurality of second openings 124 may correspond to the plurality of first openings 114 (illustrated in FIGS. 2A-2C). The second wall 122 illustrated in FIG. 3 defines a pair of second openings 124 therethrough.

The at least one second opening 124 may be substantially similar in shape and dimensions to the at least one first opening 114 (illustrated in FIGS. 2A-2C). In some cases, the at least one second opening 124 may be congruent with the at least one first opening 114. As illustrated in FIG. 3, each of the pair of second openings 124 may be substantially similar in shape and dimensions to a corresponding first opening 114 from the pair of first openings 114.

Specifically, the at least one second opening 124 may comprise the central opening portion 130 and the pair of elongate opening portions 132 extending from the opposing sides of the central opening portion 130. The central opening portion 130 may further define the maximum width 130W of the at least one second opening 124.

As a result, each of the at least one first opening 114 and the at least one second opening 124 may comprise the central opening portion 130 and the pair of elongate opening portions 132 extending from the opposing sides of the central opening portion 130. Further, the central opening portion 130 may define the maximum width 130W of each of the at least one first opening 114 and the at least one second opening 124. In other words, the central opening portion 130 may define the maximum width 130W of the at least one first opening 114 and the maximum width 130W of the at least one second opening 124. While referred to by the same reference character, the maximum width 130W of the at least one first opening 114 may differ from the maximum width 130W of the at least one second opening 124.

The second wall 122 may further define a longitudinal axis 123 along its length. The longitudinal axis 123 of the second wall 122 may be substantially parallel to the x-axis and the longitudinal axis 113 of the first wall 112 (illustrated in FIG. 2B). The at least one second opening 124 may further define the opening axis 133 along its length. That is, each of the at least one first opening 114 and the at least one second opening 124 may define the opening axis 133 along its length. Therefore, the opening axis 133 may be further inclined to the longitudinal axis 123 by the opening angle θ. The opening angle θ may be from 0 degrees (i.e., substantially parallel to the longitudinal axis 123) to 90 degrees (i.e., substantially perpendicular to the longitudinal axis 123). As illustrated in FIG. 3, the opening angle θ may be about 45 degrees. The opening angle θ is preferably less than 90 degrees (for example, about 45 degrees) to allow for a reduced dimension of the second wall 122 along an axis (y-axis in FIG. 3) perpendicular to the longitudinal axis 123.

Further, as illustrated in FIG. 3, the foldable blank 121 may further comprise a first bottom edge 125A, a second bottom edge 125B, a third bottom edge 125C, and a fourth bottom edge 125D. The first, second, third, and fourth bottom edges 125A-125D may collectively bound the second wall 122. The foldable blank 121 may further comprise a first side wall 126A, a second side wall 126B, a third side wall 126C, and a fourth side wall 126D. The first, second, third, and fourth side walls 126A-126D may be foldably connected to the second wall 122 at the respective first, second, third, and fourth bottom edges 125A-125D.

The foldable blank 121 may further comprise a first flange 127A, a second flange 127B, a third flange 127C, and a fourth flange 127D. The first, second, third, and fourth flanges 127A-127D may be foldably connected to the respective first, second, third, and fourth side walls 126A-126D. The foldable blank 121 may further comprise a first wing 128A, a second wing 128B, a third wing 128C, and a fourth wing 128D. The first and second wings 128A, 128B may be foldably connected to the first side wall 126A at opposing ends thereof. The third and fourth wings 128C, 128D may be foldably connected to the third side wall 126C at opposing ends thereof. The first and fourth wings 128A, 128D may comprise corresponding first interlocking notches 129A. Further, the second and third wings 128B, 128C may comprise corresponding second interlocking notches 129B.

One method of assembling the at least one second container 120 from the foldable blank 121 may comprise the following steps.

First, the third and fourth wings 128C, 128D may be folded towards the third side wall 126C. Subsequently, the third side wall 126C may be folded towards the second wall 122.

Second, the first and second wings 128A, 128B may be folded towards the first side wall 126A. Subsequently, the first side wall 126A may be folded towards the second wall 122.

Third, the first wing 128A may be interlocked with the fourth wing 128D by connecting the first interlocking notches 129A, and the second wing 120B may be interlocked with the third wing 128C by connecting the second interlocking notches 129B. After interlocking the first wing 128A with the fourth wing 128D and the second wing 128B with the third wing 128C, each of the first side wall 126A and the third side wall 126C may be substantially perpendicular to the second wall 122.

Fourth, the second and fourth side walls 126B, 126D may be folded towards the second wall 122. Subsequently, the second and fourth flanges 127B, 127D may be folded towards the second wall 122.

Fifth, the first and third flanges 127A, 127C may be folded towards the second wall 122, such that each of the first and third flanges 127A, 127C partially overlaps with the second and fourth flanges 127B, 127D.

By following steps first to fifth, the at least one second container 120 may be assembled from the foldable blank 121. Subsequent to the fifth step, the first and third flanges 127A, 127C may be fastened, for example, by tape, staples, etc., such that the at least one second container 120 may retain its assembled state.

Figure 4:
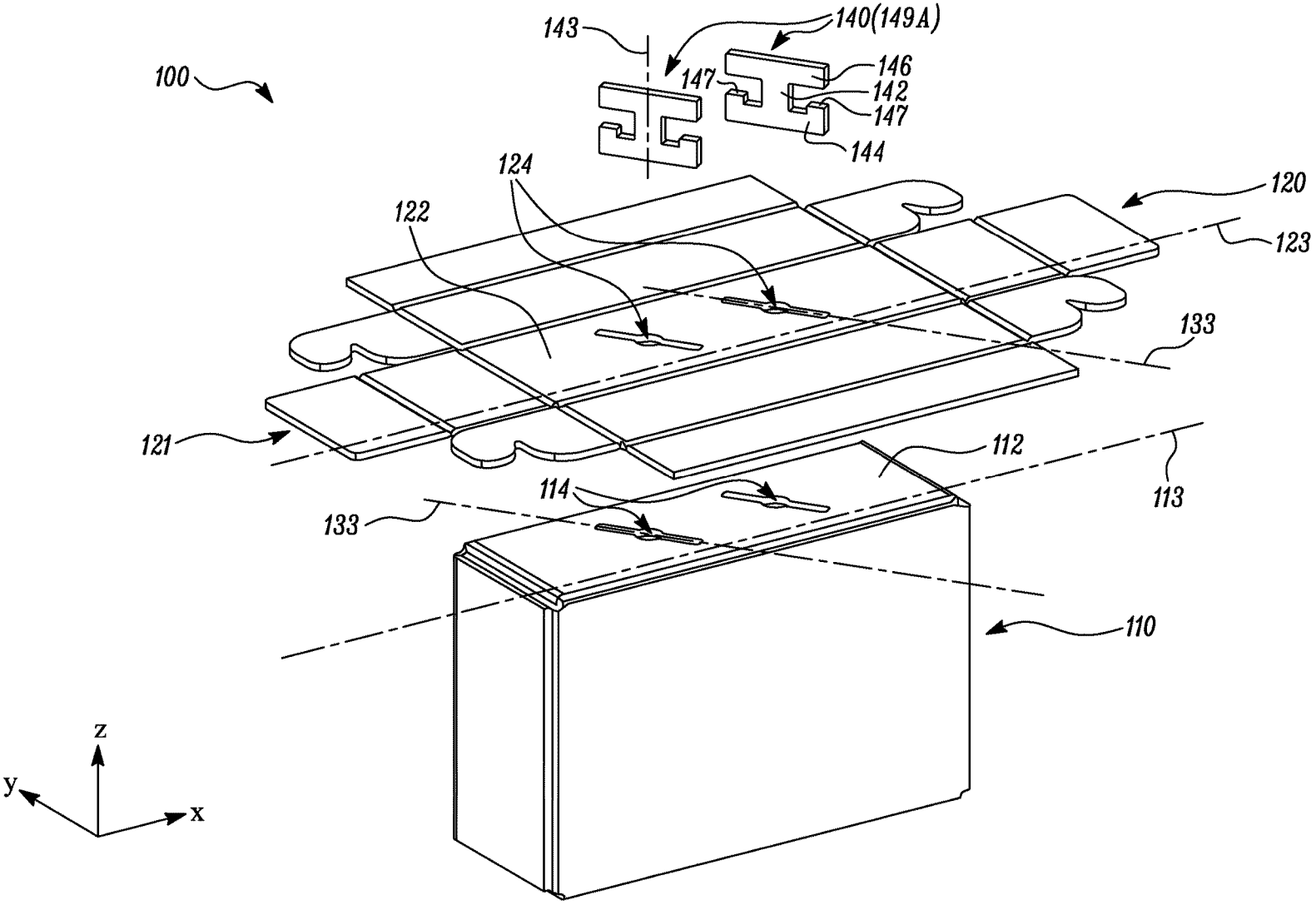
FIG. 4 is an exploded perspective view of the container system of FIG. 1.

FIG. 4 illustrates an exploded perspective view of the container system 100 according to the invention. The at least one second container 120 is illustrated in the disassembled state.

The container system 100 further comprises at least one connecting member 140. The container system 100 may comprise a single connecting member 140, or a plurality of connecting members 140. In other words, the at least one connecting member 140 may comprise the single connecting member 140, or the plurality of connecting members 140. The container system 100 illustrated in FIG. 4 comprises a pair of connecting member 140.

Figure 5:
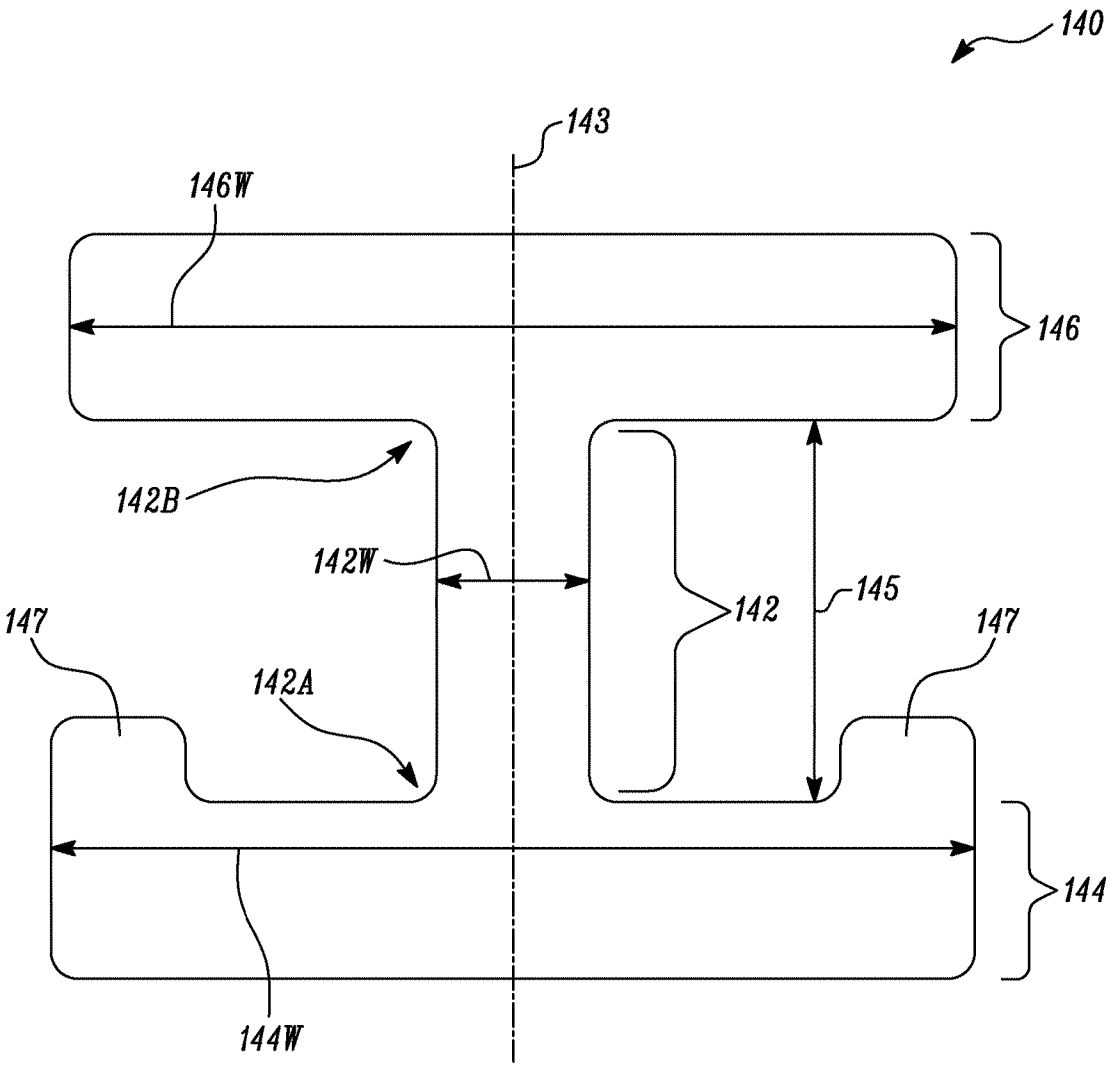
FIG. 5 is a front view of a connecting member of the container system of FIG. 4.

The at least one connecting member 140 of FIG. 4 is illustrated in more detail in FIG. 5. Referring to FIGS. 4 and 5, the at least one connecting member 140 comprises a narrow portion 142 extending between a first end 142A and a second end 142B opposing the first end 142A. The at least one connecting member 140 further comprises a first wide portion 144 disposed at the first end 142A of the narrow portion 142, and a second wide portion 146 disposed at the second end 142B of the narrow portion 142. The narrow portion 142 therefore connects the first wide portion 144 to the second wide portion 146. The at least one connecting member 140 may define a minimum distance 145 between the first wide portion 144 and the second wide portion 146.

The narrow portion 142 comprises a width 142W, the first wide portion 144 comprises a width 144W, and the second wide portion 146 comprises a width 146W. The width 142W of the narrow portion 142 is less than the width 144W, 146W of each of the first wide portion 144 and the second wide portion 146. In other words, each of the width 144W of the first wide portion 144 and the width 146W of the second wide portion 146 is greater than the width 142W of the narrow portion 142.

Referring to FIGS. 2B, 3, 4, and 5, the width 144W of the first wide portion 144 is greater than the maximum width 130W of the at least one first opening 114. Further, the width 146W of the second wide portion 146 is greater than the maximum width 130W of the at least one second opening 124. The width 142W of the narrow portion 142 may be less than or equal to the maximum width 130W of the central opening portion 130, and the width 142W of the narrow portion 142 may be greater than the width 132W of each of the pair of elongate opening portions 132.

The at least one connecting member 140 may define a connection axis 143 extending along the narrow portion 142. The connection axis 143 may be substantially parallel to the z-axis. As illustrated in FIGS. 4 and 5, each of the first wide portion 144 and the second wide portion 146 may extend substantially normally to the connection axis 143. Alternatively, each of the first wide portion 144 and the second wide portion 146 may be obliquely inclined (e.g., from 20 degrees to 60 degrees) to the connection axis 143.

The at least one connecting member 140 may further comprise at least one end projection 147 extending from the first wide portion 144 towards the second wide portion 146. The at least one end projection 147 may extend substantially along the connection axis 143. Alternatively, the at least one end projection 147 may be obliquely inclined (e.g., from 20 degrees to 60 degrees) to the connection axis 143. The at least one connecting member 140 illustrated in FIGS. 4 and 5 comprises a pair of end projections 147 extending from corresponding opposing ends of the first wide portion 144 towards the second wide portion 146. In other words, the at least one end projection 147 may comprise the pair of end projections 147 extending from the corresponding opposing ends of the first wide portion 144 towards the second wide portion 146. Specifically, each connecting member 140 illustrated in FIG. 4 comprises the pair of end projections 147 extending from the corresponding opposing ends of the first wide portion 144 towards the second wide portion 146. It may be noted that the at least one end projection 147 is optional and may be omitted from the at least one connecting member 140.

The at least one connecting member 140 is illustrated in a first orientation 149A in FIG. 4. The at least one connecting member 140 may be at least partially insertable through the at least one second opening 124 and the at least one first opening 114 in the first orientation 149A. As shown in FIG. 4, in the first orientation 149A, each of the first wide portion 144 and the second wide portion 146 may be aligned with the opening axis 133, such that the first wide portion 144 is insertable through each of the at least one first opening 114 and the at least one second opening 124.

Figure 6A:
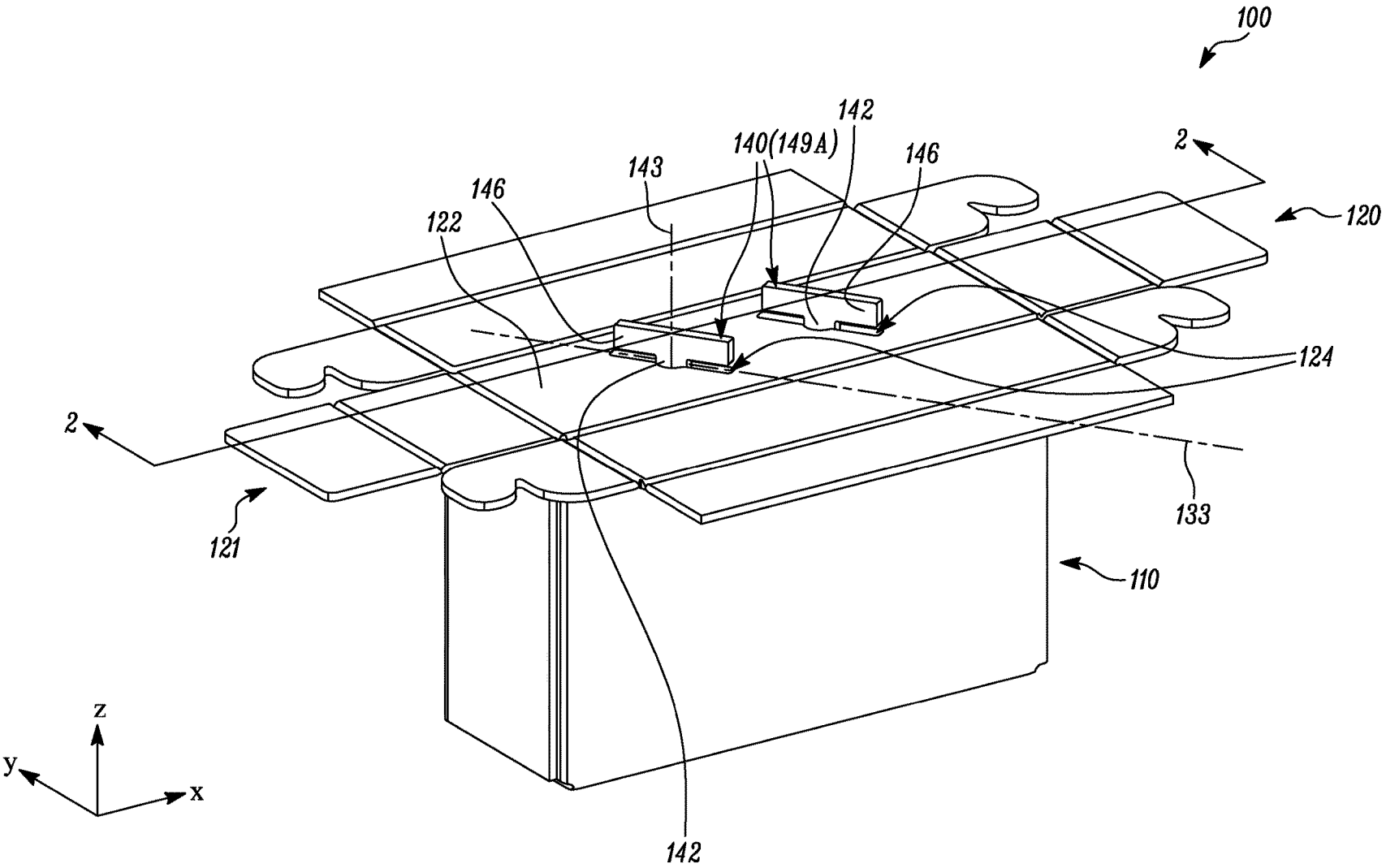
FIG. 6A is a perspective view of the container system of FIG. 4 with the connecting member at least partially received within a first opening of the first container and a second opening of the second container.
Figure 6B:
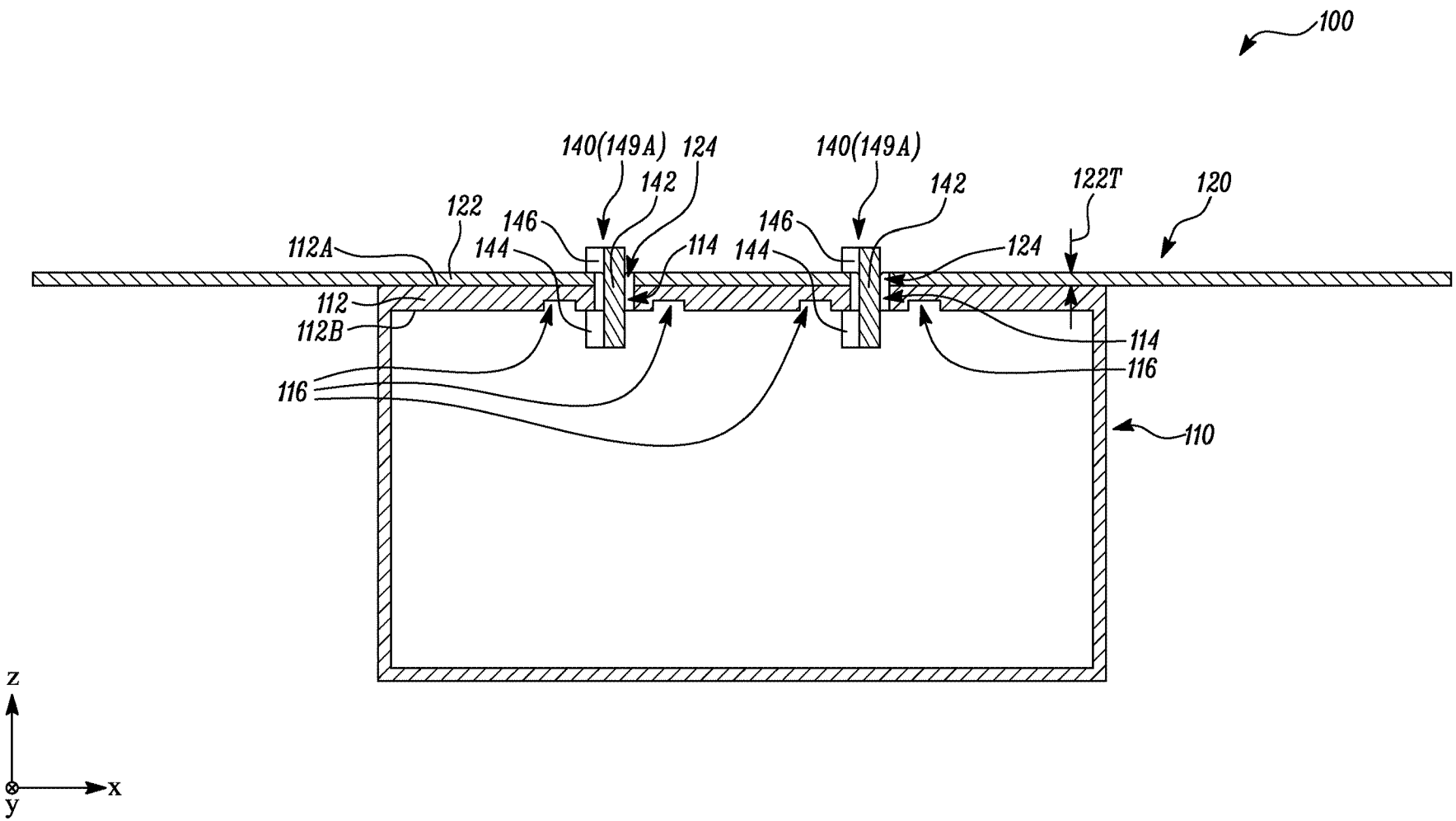
FIG. 6B is a sectional view of the container system taken along a line 2-2 of FIG. 6A.

FIG. 6A illustrates a perspective view of the container system 100 with the at least one connecting member 140 at least partially received within the at least one first opening 114 and the at least one second opening 124 in the first orientation 149A. FIG. 6B illustrates a sectional view of the container system 100 taken along a line 2-2 of FIG. 6A.

Referring to FIGS. 6A and 6B, the second wall 122 is disposed adjacent to the first wall 112. Specifically, the second wall 122 may be disposed adjacent to the first major surface 112A of the first wall 112. As a result, the first major surface 112A may face the second wall 122. As illustrated in FIG. 6B, in some cases, the second wall 122 may be directly disposed on the first major surface 112A of the first wall 112. It may be noted that the first container 110 may be in a closed configuration prior to disposing the second wall 122 of the at least one second container 120 adjacent to the first wall 112 of the first container 110. The second wall 122 may comprise a thickness 122T along the z-axis.

Further, the at least one second opening 124 is aligned with the at least one first opening 114. That is, the second wall 122 may be disposed adjacent to the first wall 112, such that the at least one second opening 124 is aligned with the at least one first opening 114. In some examples, each second opening 124 from the plurality of second openings 124 may be aligned with a corresponding first opening 114 from the plurality of first openings 114. Specifically, as illustrated in FIGS. 6A and 6B, each second opening 124 from the pair of second openings 124 may be aligned with a corresponding first opening 114 from the pair of first openings 114.

The at least one connecting member 140 may be at least partially insertable through the at least one second opening 124 and the at least one first opening 114 in the first orientation 149A, such that the narrow portion 142 is at least partially received within each of the at least one first opening 114 and the at least one second opening 124, the first wide portion 144 is received within the first container 110 adjacent to the first wall 112, and the second wide portion 146 is disposed adjacent to the second wall 122. Further, in the first orientation 149A, each of the first wide portion 144 and the second wide portion 146 may be substantially parallel to the opening axis 133.

Figure 7A:
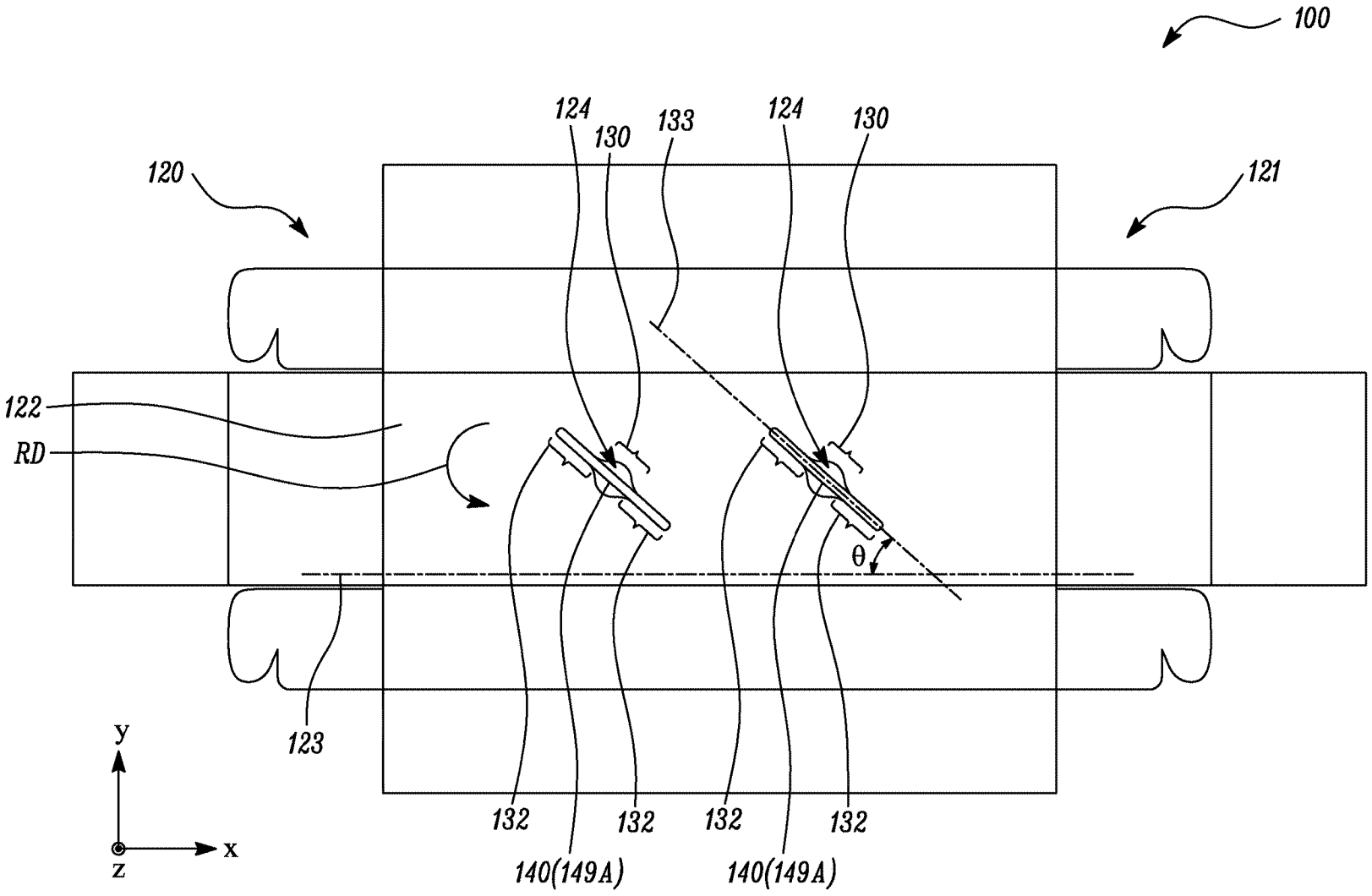
FIG. 7A is a top view of the container system of FIG. 6A with the connecting member in a first orientation.
Figure 7B:
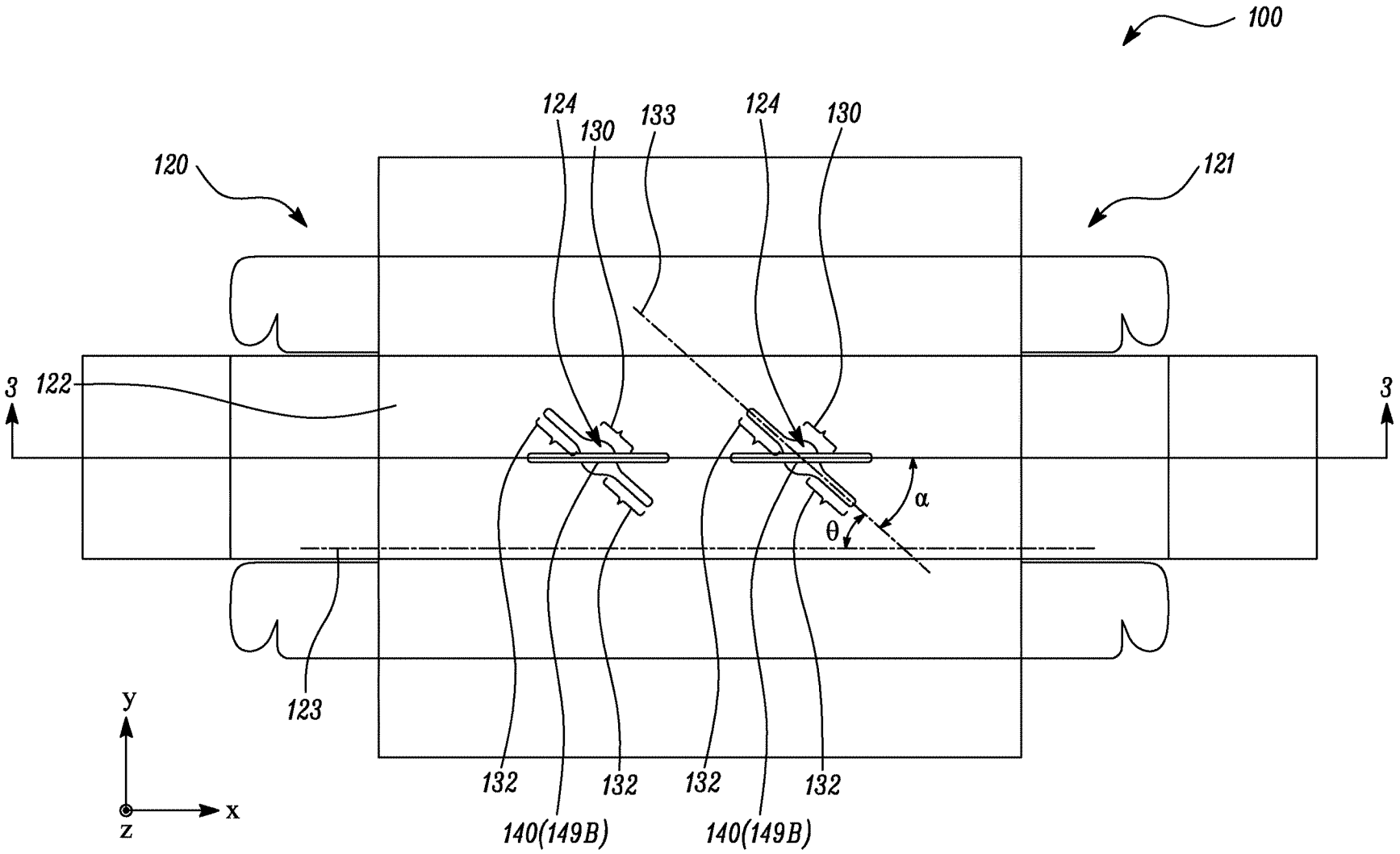
FIG. 7B is a top view of the container system of FIG. 6A with the connecting member in a second orientation.

FIGS. 7A and 7B illustrate top views of the container system 100 illustrating a rotation of the at least one connecting member 140 between the first orientation 149A and a second orientation 149B. Specifically, upon insertion, the at least one connecting member 140 may be rotatable from the first orientation 149A to the second orientation 149B (e.g., in a rotational direction RD illustrated in FIG. 7A), such that the at least one connecting member 140 secures the at least one second container 120 to the first container 110 in the second orientation 149B. The at least one connecting member 140 may be rotatable about the connection axis 143 (illustrated in FIG. 6A) between the first orientation 149A and the second orientation 149B. The at least one connecting member 140 may be rotatable about the z-axis between the first orientation 149A and the second orientation 149B.

Referring to FIGS. 2B, 3, 5, 7A, and 7B, the width 142W of the narrow portion 142 may be less than or equal to the maximum width 130W of the central opening portion 130, such that the at least one connecting member 140 may be rotatable relative to the central opening portion 130 between the first orientation 149A and the second orientation 149B. Further, the width 142W of the narrow portion 142 may be greater than the width 132W of each of the pair of elongate opening portions 132, such that the narrow portion 142 may be secured within the central opening portion 130 of each of the at least one first and second openings 114, 124.

Figure 7C:
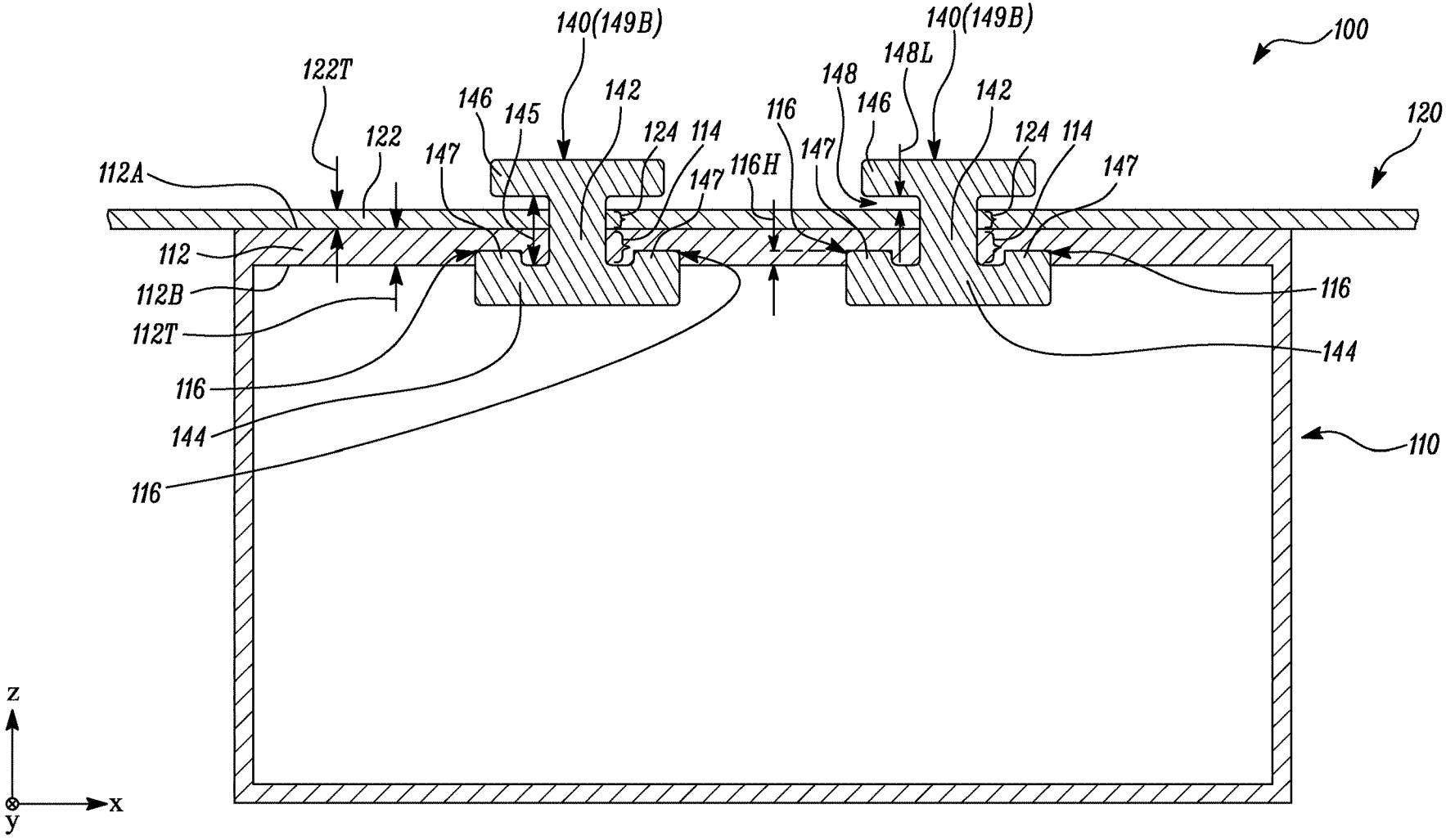
FIG. 7C is a sectional view of the container system taken along a line 3-3 of FIG. 7B.

FIG. 7C illustrates a sectional view of the container system 100 taken along a line 3-3 of FIG. 7B. Referring to FIGS. 7B and 7C, in the second orientation 149B, each of the first wide portion 144 and the second wide portion 146 may be misaligned with the opening axis 133. Specifically, in the second orientation 149B, each of the first wide portion 144 and the second wide portion 146 may be inclined to the opening axis 133 by an inclination angle $\alpha$. The inclination angle $\alpha$ may be any angle that allows at least a portion of the first wide portion 144 and/or at least a portion of the second wide portion 146 to be misaligned with the opening axis 133. Preferably, the inclination angle α is between about 15 degrees and 90 degrees. However, the inclination angle α may be between about 30 degrees and about 60 degrees. As illustrated in FIG. 7B, the inclination angle α may be about 45 degrees. Further, in some cases, the inclination angle α may be substantially equal to the opening angle θ.

Further, as illustrated in FIG. 7B, in the second orientation 149B, each of the first wide portion 144 and the second wide portion 146 may be disposed parallel to the longitudinal axis 123 and inclined to the opening axis 133 by the inclination angle α (about 45 degrees in FIG. 7B). As discussed above, the longitudinal axis 123 of the at least one second container 120 may be parallel to the longitudinal axis 113 (illustrated in FIG. 4) of the first container 110 and the x-axis. Therefore, in the second orientation 149B, each of the first wide portion 144 and the second wide portion 146 may further be disposed parallel to the longitudinal axis 113 of the first wall 112 and inclined to the opening axis 133 by the inclination angle α. Further, as discussed above, the at least one connecting member 140 may secure the at least one second container 120 to the first container 110 when in the second orientation 149B.

Referring to FIG. 7C, the at least one connecting member 140 is at least partially received within the at least one first opening 114 and the at least one second opening 124. In some examples, each of the plurality of connecting members 140 may be at least partially received within a corresponding first opening 114 from the plurality of first openings 114 and a corresponding second opening 124 from the plurality of second openings 124. As illustrated in FIG. 7C, each connecting member 140 from the pair of connecting members 140 may be at least partially received with a corresponding first opening 114 from the pair of first openings 114 and a corresponding second opening 124 from the pair of second openings 124.

The narrow portion 142 is at least partially received within each of the at least one first opening 114 and the at least one second opening 124. As illustrated in FIG. 7C, the narrow portion 142 of each connecting member 140 may be at least partially received within each of the corresponding first opening 114 and the corresponding second opening 124.

The first wide portion 144 is received within the first container 110. The first wide portion 144 extends across the at least one first opening 114 and engages the first wall 112 on opposing sides of the at least one first opening 114. As illustrated in FIG. 7C, the first wide portion 144 of each connecting member 140 may extend across the corresponding first opening 114 and may engage the first wall 112 on opposing sides of the corresponding first opening 114.

The second wide portion 146 is disposed adjacent to the second wall 122 and extends across the at least one second opening 124, such that the at least one connecting member 140 secures the at least one second container 120 to the first container 110. As illustrated in FIG. 7C, the second wide portion 146 of each connecting member 140 may be disposed adjacent to the second wall 122 and may extend across the corresponding second opening 124. The minimum distance 145 (also illustrated in FIG. 5) between the first wide portion 144 and the second wide portion 146 may be greater than or equal to a sum of the thickness 112T of the first wall 112 and the thickness 122T of the second wall 122.

In the second orientation 149B, the first and the second wide portions 144, 146 may prevent each connecting member 140 from being removed from the corresponding first and second openings 114, 124. Therefore, in the second orientation 149B, each connecting member 140 may prevent the at least one second container 120 from being separated from the first container 110.

Further, the at least one end projection 147 may be at least partially received in the at least one recess 116, thereby preventing rotation of the first wide portion 144 relative to the first wall 112. As a result, the at least one connecting member 140 may be secured in the second orientation 149B. As illustrated in FIG. 7C, the connecting member 140 may define a gap 148 between the second wide portion 146 and the second wall 122 when the at least one end projection 147 is received in the at least one recess 116. The gap 148 may comprise a length 148L substantially along the z-axis. The length 148L of the gap 148 may be substantially equal to the height 116H of the at least one recess 116.

As illustrated in FIG. 7C, each of the pair of end projections 147 may be at least partially received in a corresponding recess 116 from the pair of recesses 116, thereby preventing rotation of the first wide portion 144 relative to the first wall 112. Therefore, upon being at least partially received within the pair of recesses 116, the pair of end projections 147 may rotationally lock the corresponding connecting member 140 in the second orientation 149B, and prevent any undesired or accidental rotation of the corresponding connecting member 140 from the second orientation 149B. As discussed above, the at least one recess 116 and the at least one end projection 147 may be omitted from the container system 100. In examples where the at least one recess 116 and the at least one end projection 147 are omitted, the at least one connecting member 140 may not define the gap 148.

Figure 8:
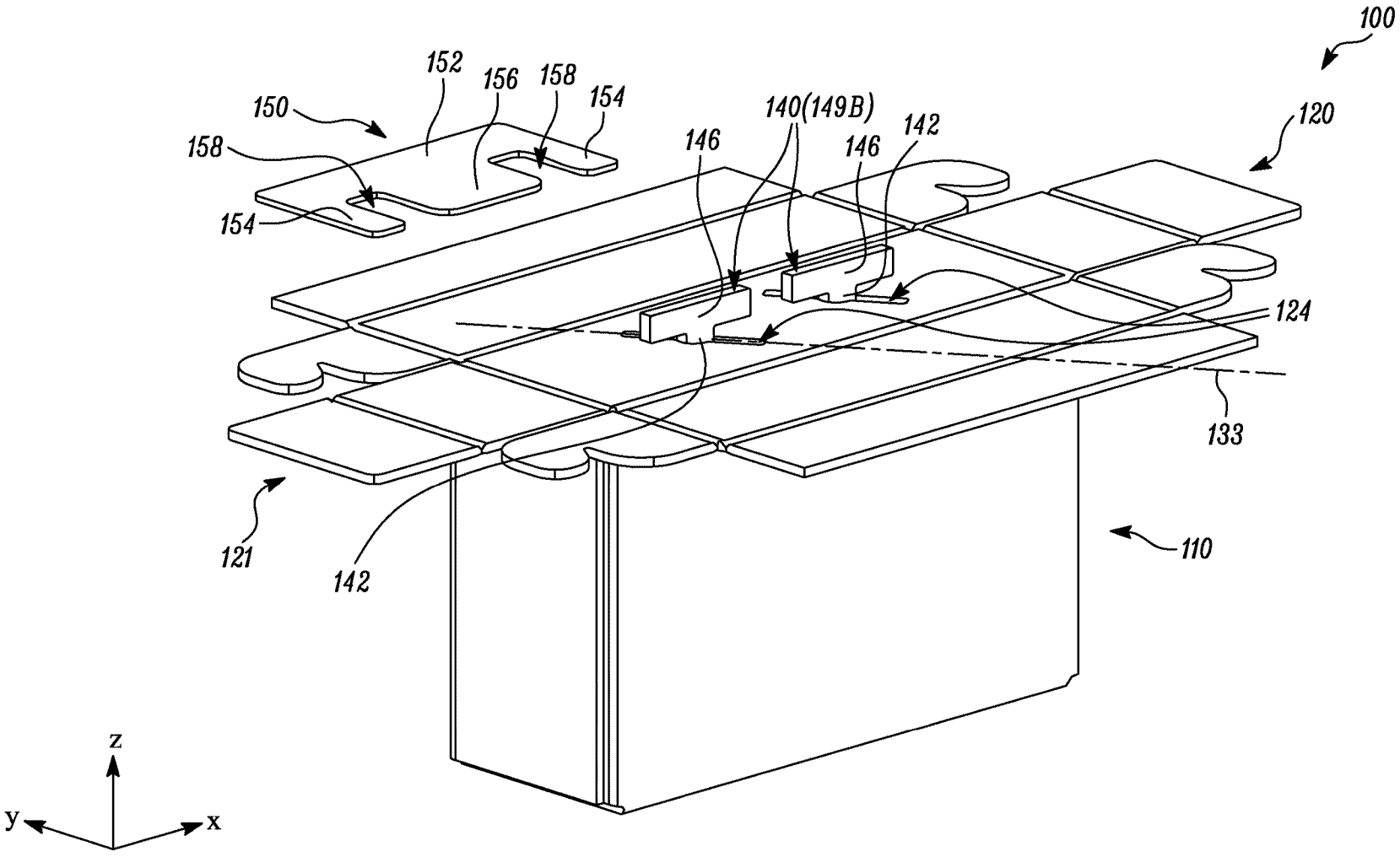
FIG. 8 is a perspective view of the container system with a securing member in a detached state according to the invention.

As illustrated in FIG. 8, the container system 100 may further comprise a securing member 150. The securing member 150 is shown in a detached state in FIG. 8. Specifically, the securing member 150 is detached from the container system 100 in FIG. 8, and is not yet assembled with the container system 100. The securing member 150 may comprise at least one notch 158. The at least one notch 158 may correspond to the at least one connecting member 140. The securing member 150 may comprise a plurality of notches 158 corresponding to the plurality of connecting members 140. In other words, the at least one notch 158 may comprise a single notch 158 for a single connecting member 140, or the plurality of notches 158 corresponding to the plurality of connecting members 140. The securing member 150 illustrated in FIG. 8 corresponds to the pair of connecting members 140. As a result, the at least one notch 158 may comprise a pair of notches 158 spaced apart from each other.

Figure 9:
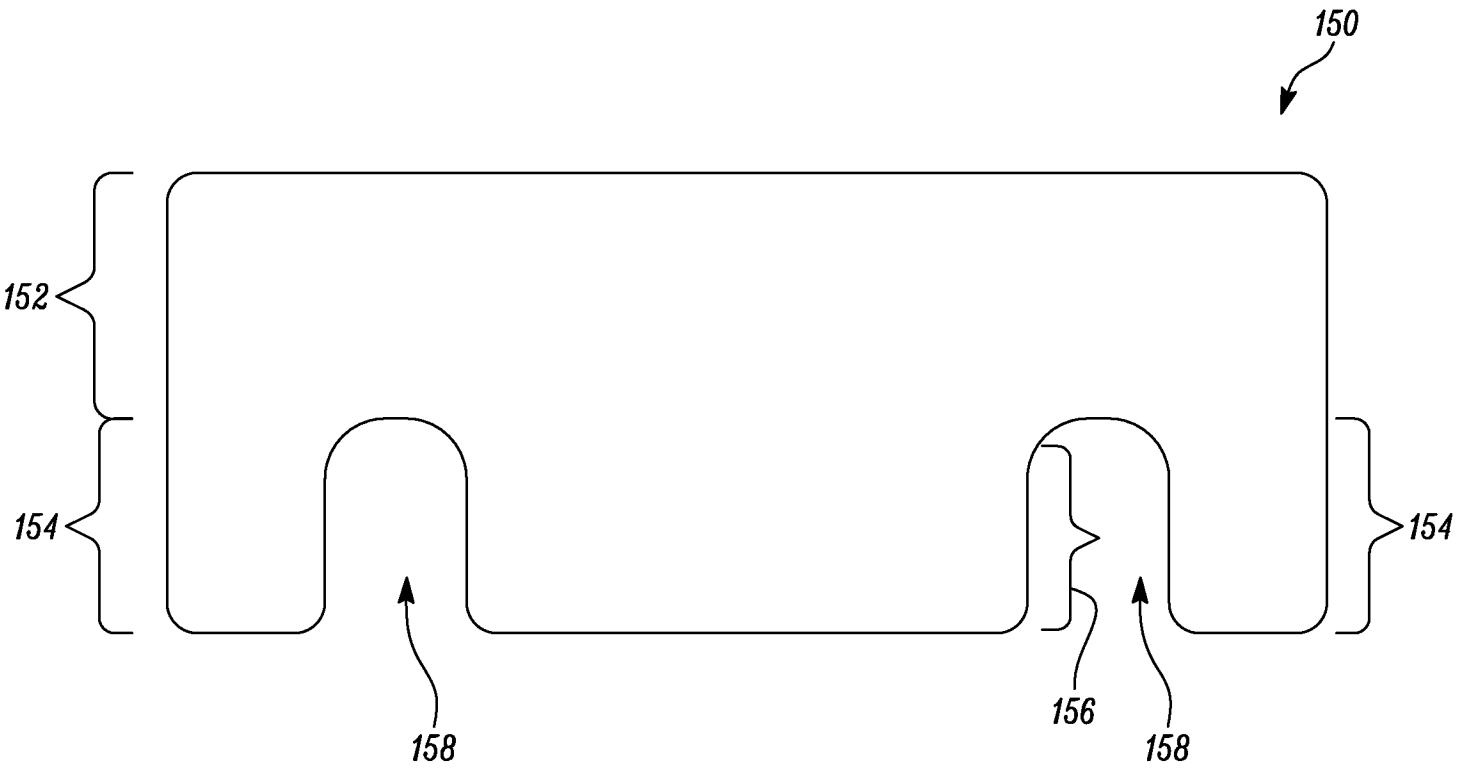
FIG. 9 is a top view of the securing member of the container system of FIG. 8.

The securing member 150 of FIG. 8 is illustrated in more detail in FIG. 9. Referring to FIGS. 8 and 9, the securing member 150 may comprise a longitudinal portion 152, a pair of end extensions 154 extending from opposing ends of the longitudinal portion 152, and an intermediate extension 156 extending from the longitudinal portion 152 between the pair of end extensions 154, such that the intermediate extension 156, the pair of end extensions 154, and the longitudinal portion 152 together define the pair of notches 158 therebetween. Each of the pair of notches 158 may be aligned with the narrow portion 142 of a corresponding connecting member 140 from the pair of connecting members 140.

Figure 10A:
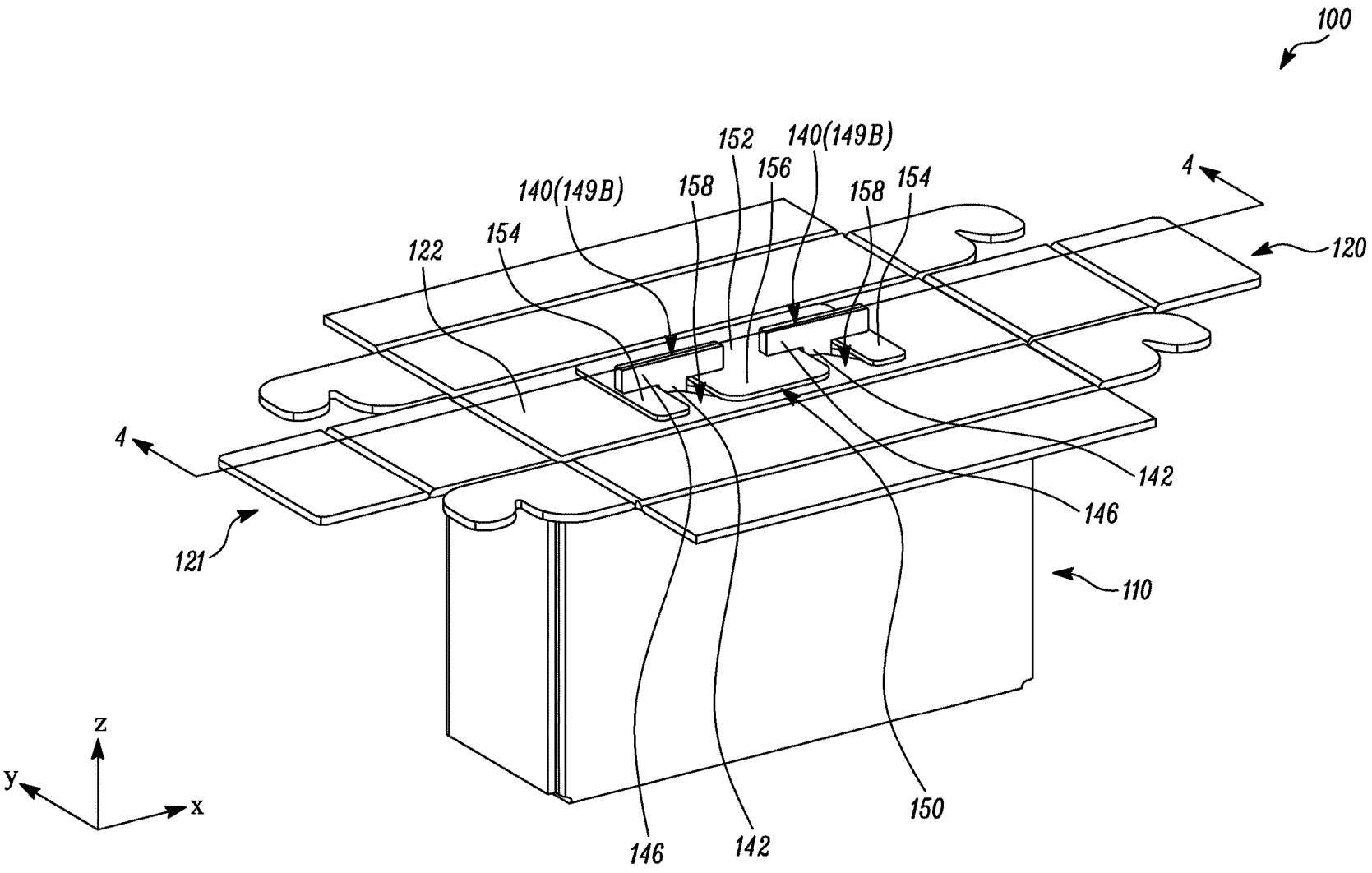
FIG. 10A is a perspective view of the container system of FIG. 8 with the securing member in an engaged state.
Figure 10B:
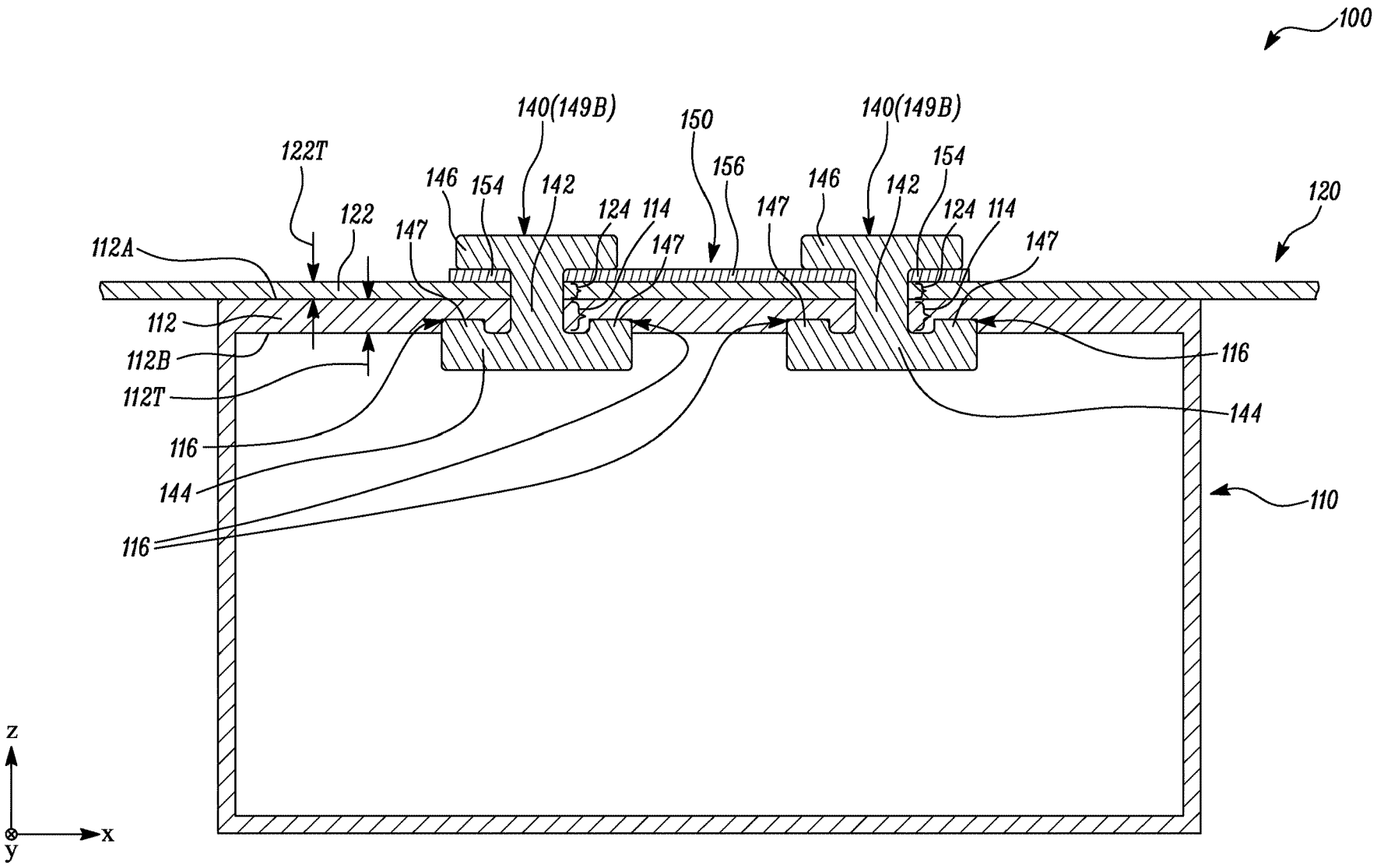
FIG. 10B is a sectional view of the container system taken along a line 4-4 of FIG. 10A.

FIG. 10A illustrates a perspective view of the container system 100 with the securing member 150 in an engaged state. In the engaged state, the securing member 150 engages the at least one connecting member 140 and the second wall 122. FIG. 10B illustrates a sectional view of the container system 100 taken along a line 4-4 of FIG. 10A.

Referring to FIGS. 10A and 10B, the securing member 150 may be disposed on the second wall 122. Specifically, the securing member 150 may be at least partially received between the second wide portion 146 and the second wall 122. The securing member 150 may be at least partially received in the gap 148 (illustrated in FIG. 7C). A thickness of the securing member 150 along the z-axis may be greater than or equal to the length 148L of the gap 148. It may be noted that the securing member 150 is optional and may be omitted from the container system 100. In cases where the securing member 150 is omitted, the gap 148 may be absent, and the second wide portion 146 may directly engage the second wall 122.

Further, the narrow portion 142 may be at least partially received within the at least one notch 158. As a result, the securing member 150 may engage the narrow portion 142, the second wide portion 146, and the second wall 122. If a plurality of connecting members 140 are used, the narrow portion 142 of each of the plurality of connecting members 140 may be at least partially received within a corresponding notch 158 from the plurality of notches 158. As a result, the securing member 150 may engage the narrow portion 142 and the second wide portion 146 of each of the plurality of connecting members 140, and the second wall 122.

As illustrated in FIGS. 10A, each of the pair of notches 158 may at least partially receive therein the narrow portion 142 of the corresponding connecting member 140. Each of the pair of end extensions 154 may be at least partially received between the second wide portion 146 of the corresponding connecting member 140 and the second wall 122. Each of the pair of end extensions 154 may engage the narrow portion 142 and the second wide portion 146 of the corresponding connecting member 140, and the second wall 122.

Further, the intermediate extension 156 may at least partially extend between the pair of connecting members 140 and may be at least partially received between the second wide portion 146 of each connecting member 140 and the second wall 122. The intermediate extension 156 may engage the narrow portion 142 and the second wide portion 146 of each connecting member 140, and the second wall 122, such that the pair of connecting members 140 and the securing member 150 secure the second container 120 to the first container 110.

Figure 11:
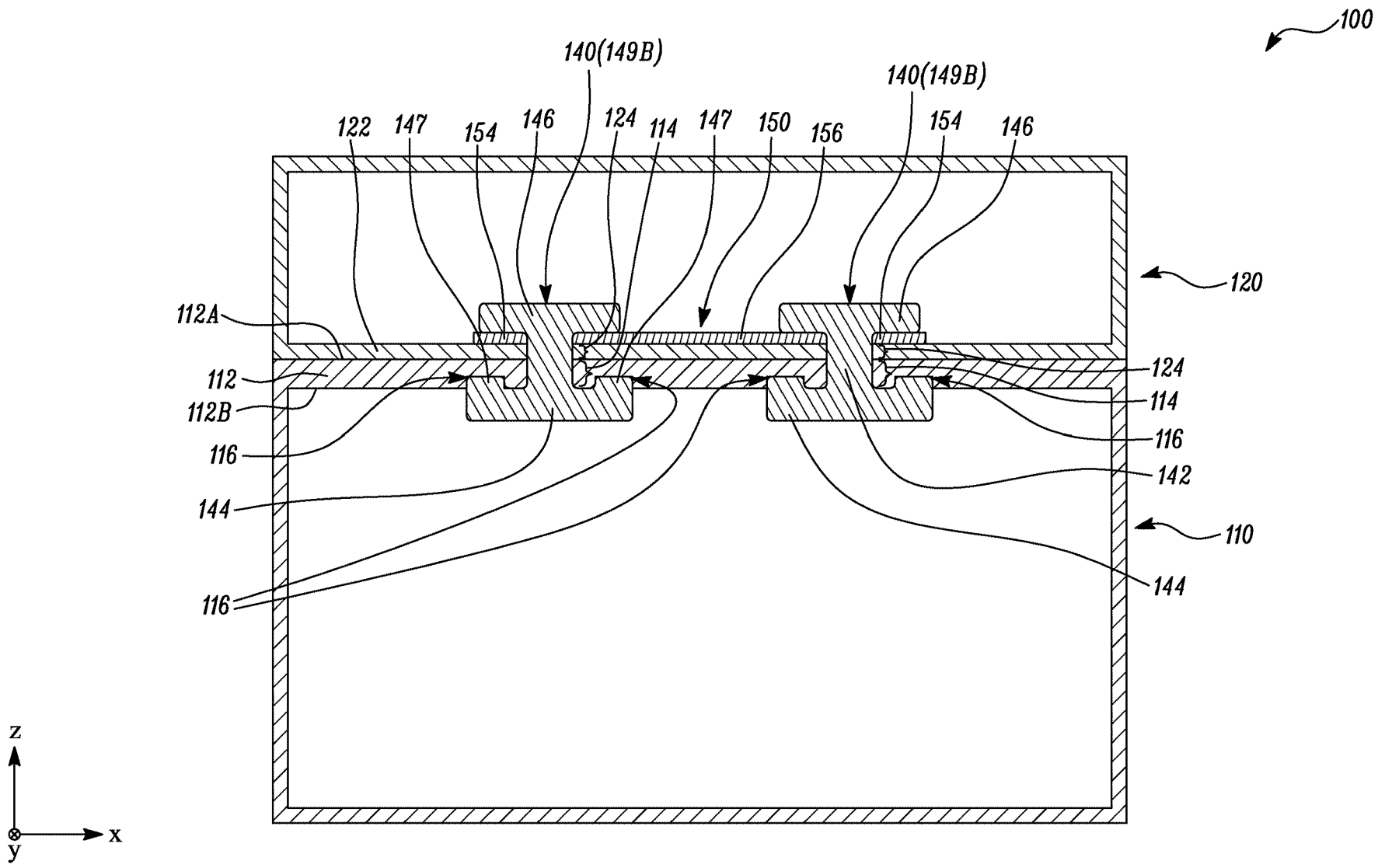
FIG. 11 is a sectional side view of the container system of FIGS. 10A and 10B with the second container in an assembled state.

FIG. 11 shows a sectional side view of the container system 100 with the securing member 150, and the at least one second container 120 in an assembled state. The at least one second container 120 may be assembled from the foldable blank 121 (illustrated in FIG. 3), as discussed above with reference to FIG. 3.

The at least one connecting member 140 may be configured based on one or more primary products (not illustrated) to be contained within the first container 110 and one or more secondary products (not illustrated) to be contained within the at least one second container 120. Specifically, dimensions of the at least one connecting member 140 may be selected based upon a total weight of the one or more primary products and the one or more secondary products. For example, a weight density (or thickness) of the at least one connecting member 140 may be proportional to the total weight. The container system 100 may therefore pass packaging tests, such as ISTA 6A developed by Amazon.com, Inc., of Seattle, Washington. Further, the securing member 150 may have suitable dimensions, such that the securing member 150 is itself secured at a fixed position relative to the at least one connecting member 140 during transportation. It may be noted that dimensions of the securing member 150 may further be based on the total weight of the one or more primary products and the one or more secondary products.

Figure 12A:
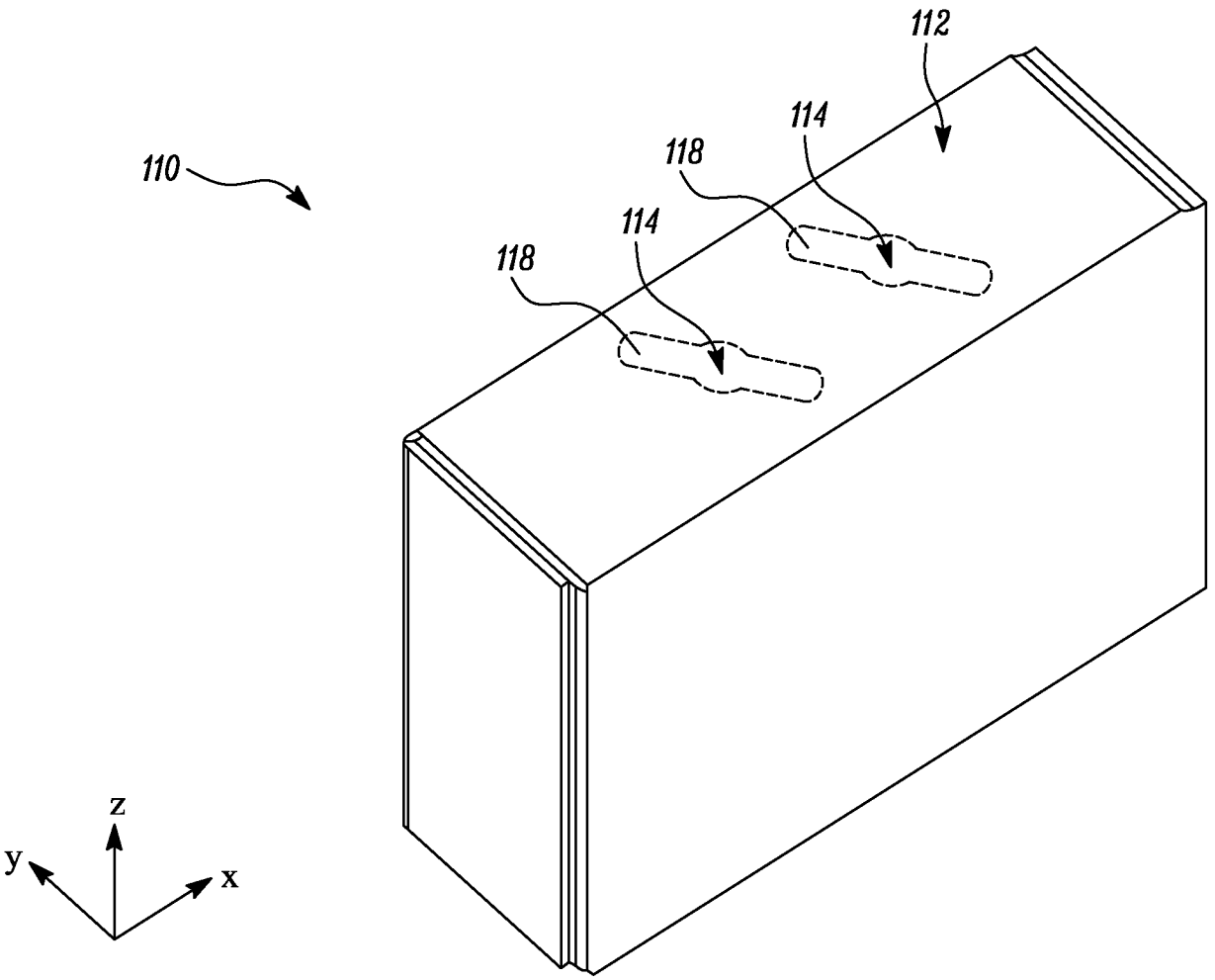
FIG. 12A is a top perspective view of the first container prior to assembling of the container system according to the invention.

FIG. 12A shows a top perspective view of the first container 110 prior to attachment with the at least one second container 120. As shown, the first container 110 may further comprise at least one first closing member 118 configured to close the at least one first opening 114 (indicated by dashed lines in FIG. 12A). The at least one first closing member 118 may be removably attached to the first wall 112 of the first container 110. The at least one first closing member 118 may be removed from the first wall 112 to reveal the at least one first opening 114. Specifically, the at least one first closing member 118 may be removed from the at least one first opening 114 prior to the first container 110 and the at least one second container 120 being attached to each other.

The at least one first closing member 118 may be integrally formed with the first container 110. For example, the first wall 112 of the first container 110 may be scored, perforated, or die-cut to form the at least one first closing member 118. Alternatively, the at least one first closing member 118 may be formed separately from the first container 110 and removably attached to the first wall 112. The at least one first closing member 118 may be interchangeably referred to as "the closing member 118".

Figure 12B:
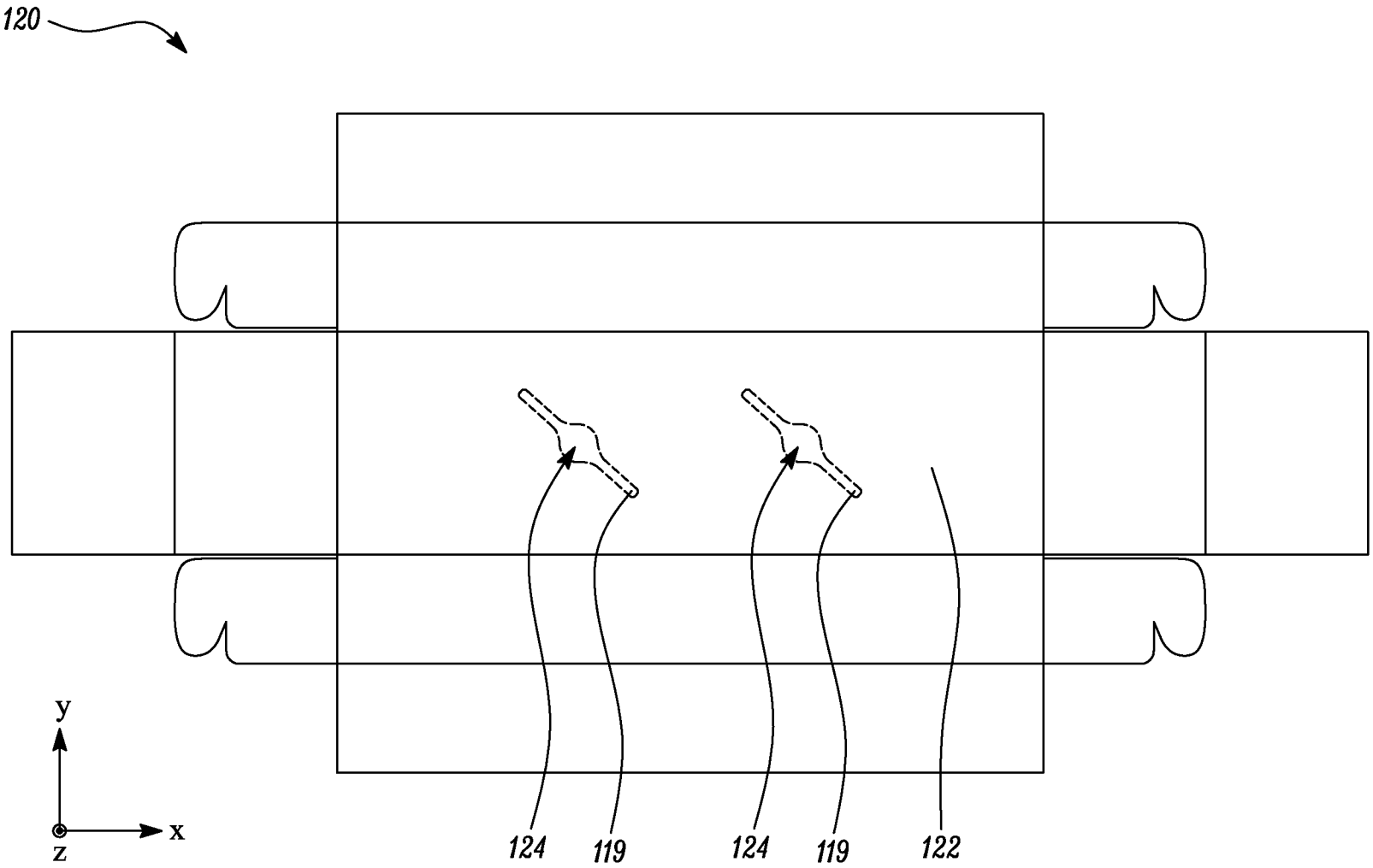
FIG. 12B is a plan view of the second container prior to assembling of the container system according to the invention.

FIG. 12B shows a plan view of the at least one second container 120 prior to attachment with the first container 110. The at least one second container 120 is shown in the disassembled state in FIG. 12B. The at least one second container 120 may further comprise at least one second closing member 119 configured to close the at least one second opening 124 (indicated by dashed lines in FIG. 12B). The at least one second closing member 119 may be removably attached to the second wall 122 of the at least one second container 120. The at least one second closing member 119 may be removed from the second wall 122 of the at least one second container 120 to reveal the at least one second opening 124. Specifically, the at least one second closing member 119 may be removed from the at least one second opening 124 prior to the first container 110 and the at least one second container 120 being attached to each other.

The at least one second closing member 119 may be integrally formed with the at least one second container 120. For example, the second wall 122 of the at least one second container 120 may be scored, perforated, or die-cut to form the at least one second closing member 119. Alternatively, the at least one second closing member 119 may be formed separately from the at least one second container 120 and removably attached to the second wall 122.

Referring to FIGS. 12A and 12B, the at least one first closing member 118 and the at least one second closing member 119 may reduce or prevent entry of undesired contaminants, insects, and the like, into the first container 110 and the at least one second container 120, respectively, before the at least one second container 120 is attached or secured to the first container 110, or in situations where the at least one second container 120 is not attached or secured to the first container 110 at all (e.g., when the first container 110 is shipped independently from the second container 120).

Figure 13:
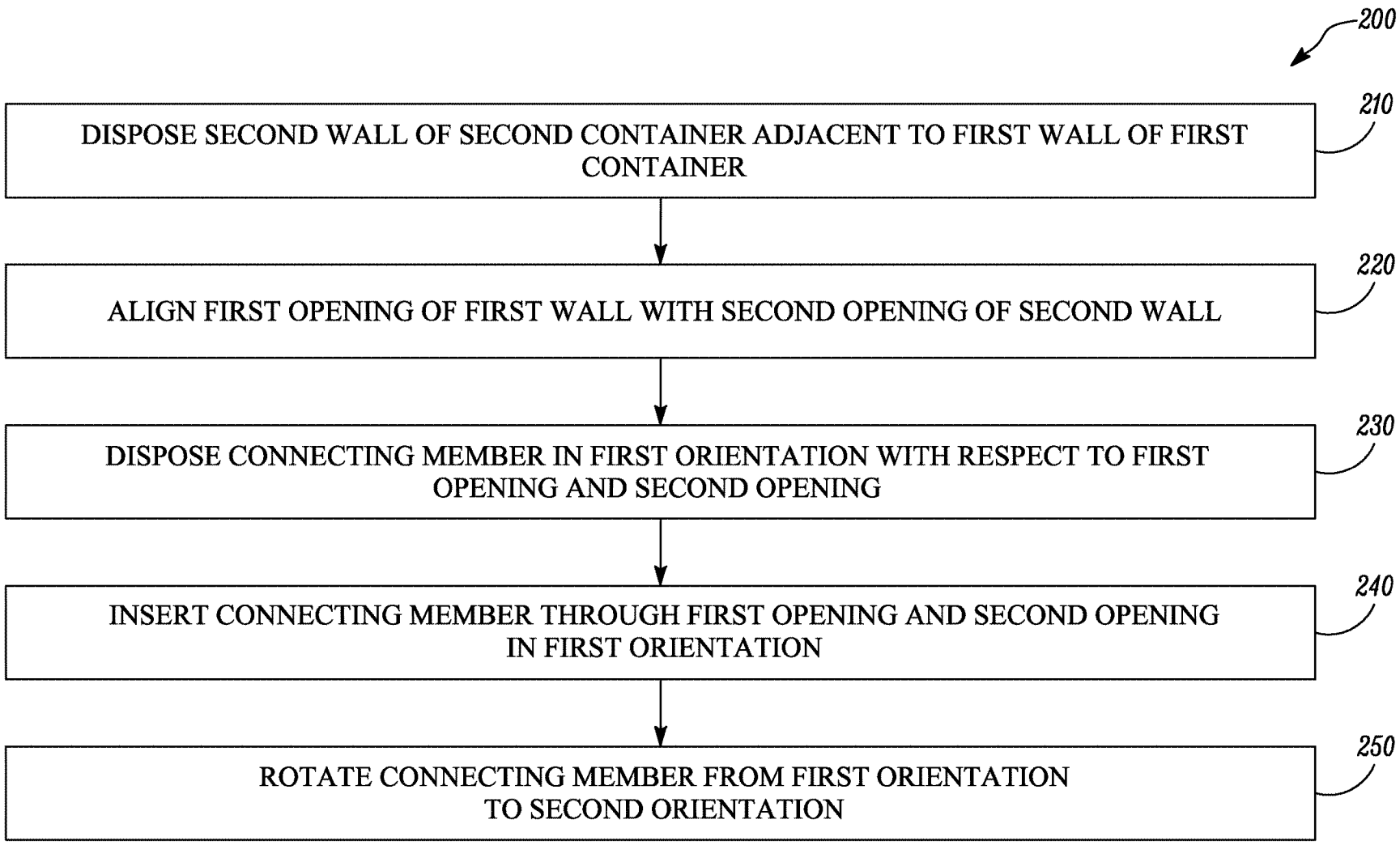
FIG. 13 is a flowchart depicting various steps of a method of assembling a container system according to the invention.

FIG. 13 illustrates a method 200 of assembling a container system according to the invention, such as the container system 100 illustrated in FIG. 1. At step 210, the method 200 comprises disposing a second wall of a second container adjacent to a first wall of a first container. For example, as illustrated in FIG. 6B, the method 200 may comprise disposing the second wall 122 of the at least one second container 120 adjacent to the first wall 112 of the first container 110.

The first container may be in a closed configuration prior to disposing the second wall of the second container adjacent to the first wall of the first container. For example, as illustrated in FIG. 4, the first container 110 may be in the closed configuration prior to disposing the second wall 122 of the at least one second container 120 adjacent to the first wall 112 of the first container 110.

The method 200 may comprise removing a closing member from the first container to reveal a first opening prior to disposing the second wall of the second container adjacent to the first wall of the first container. For example, the method 200 may comprise removing the at least one closing member 118 (illustrated in FIG. 12) from the first container 110 to reveal the at least one first opening 114 (illustrated in FIGS. 2A-2C) prior to disposing the second wall 122 of the at least one second container 120 adjacent to the first wall 112 of the first container 110.

At step 220, the method 200 further comprises aligning the first opening of the first wall with a second opening of the second wall. For example, as illustrated in FIG. 4, the method 200 may comprise aligning the at least one first opening 114 of the first wall 112 with the at least one second opening 124 of the second wall 122.

At step 230, the method 200 further comprises disposing a connecting member in a first orientation with respect to the first opening and the second opening. For example, as illustrated in FIG. 4, the method 200 may comprise disposing the at least one connecting member 140 in the first orientation 149A with respect to the at least one first opening 114 and the at least one second opening 124.

A first wide portion of the connecting member may be aligned with the first opening and a second wide portion of the connecting member may be aligned with the second opening upon disposition of the connecting member in the first orientation with respect to the first opening and the second opening. For example, as illustrated in FIG. 4, the first wide portion 144 of the at least one connecting member 140 may be aligned with the at least one first opening 114, and the second wide portion 146 of the at least one connecting member 140 may be aligned with the at least one second opening 124 upon disposition of the at least one connecting member 140 in the first orientation 149A with respect to the at least one first opening 114 and the at least one second opening 124.

At step 240, the method 200 further comprises inserting the connecting member through the first opening and the second opening in the first orientation. For example, as illustrated in FIGS. 6A and 6B, the method 200 may comprise inserting the at least one connecting member 140 through the at least one first opening 114 and the at least one second opening 124 in the first orientation 149A.

The first wide portion may be disposed adjacent to the first wall and the second wide portion may be disposed adjacent to the second wall upon insertion of the connecting member through the first opening and the second opening in the first orientation. For example, as illustrated in FIG. 6B, the first wide portion 144 may be disposed adjacent to the first wall 112 and the second wide portion 146 may be disposed adjacent to the second wall 122 upon insertion of the at least one connecting member 140 through the at least one first opening 114 and the at least one second opening 124 in the first orientation 149A.

At step 250, the method 200 further comprises rotating the connecting member from the first orientation to a second orientation, such that at least a portion of the connecting member is misaligned with the first opening and the second opening. For example, as illustrated in FIGS. 7A-7C, the method 200 may comprise rotating the at least one connecting member 140 from the first orientation 149A to the second orientation 149B, such that the at least a portion of one connecting member 140 is misaligned with the at least one first opening 114 and the at least one second opening 124.

The first wide portion may be misaligned with the first opening and the second wide portion may be misaligned with the second opening upon rotation of the connecting member from the first orientation to the second orientation. For example, as illustrated in FIGS. 7A-7C, the first wide portion 144 may be misaligned with the at least one first opening 114 and the second wide portion 146 may be misaligned with the at least one second opening 124 upon rotation of the at least one connecting member 140 from the first orientation 149A to the second orientation 149B.

The method 200 may further comprise at least partially receiving an end projection of the connecting member within a recess of the first wall, thereby preventing rotation of the connecting member relative to the first wall. For example, as illustrated in FIG. 7C, the method 200 may further comprise at least partially receiving the at least one end projection 147 of the at least one connecting member 140 within the at least one recess 116 of the first wall 112, thereby preventing rotation of the at least one connecting member 140 relative to the first wall 112.

The method 200 may further comprise inserting a securing member between the connecting member and the second wall, such that a notch of the securing member at least partially receives the connecting member therein, and the securing member engages the connecting member and the second wall. For example, as illustrated in FIGS. 10A and 10B, the method 200 may further comprise inserting the securing member 150 between the at least one connecting member 140 and the second wall 122, such that the at least one notch 158 of the securing member 150 at least partially receives the at least one connecting member 140 therein, and the securing member 150 engages the at least one connecting member 140 and the second wall 122.

The method 200 may further comprise assembling the second container from a foldable blank. For example, the method 200 may further comprise assembling the at least one second container 120 from the foldable blank 121 (illustrated in FIG. 3).

The container system 100 according to the invention may be suitable for dynamic requirements of e-commerce. The container system 100 may further be economical and environmentally friendly. The container system 100 may further provide improved shippability. The container system 100 may also have an aesthetically pleasing appearance while being easy to assemble/disassemble. This may improve customer experience and satisfaction. Moreover, the method 200 of assembling the container system 100 according to the invention may allow easy assembly and disassembly of the container system 100.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests, or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container system comprising:

a first container comprising a first wall defining at least one first opening therethrough;

at least one second container comprising a second wall disposed adjacent to the first wall, the second wall defining at least one second opening therethrough, wherein the at least one second opening is aligned with the at least one first opening; and at least one connecting member at least partially received within the at least one first opening and the at least one second opening, the at least one connecting member comprising a narrow portion extending between a first end and a second end opposing the first end, a first wide portion disposed at the first end of the narrow portion, and a second wide portion disposed at the second end of the narrow portion, wherein a width of the narrow portion is less than a width of each of the first wide portion and the second wide portion, wherein the width of the first wide portion is greater than a maximum width of the at least one first opening, and wherein the width of the second wide portion is greater than a maximum width of the at least one second opening;

wherein:

the narrow portion is at least partially received within each of the at least one first opening and the at least one second opening;

the first wide portion is received within the first container, the first wide portion extending across the at least one first opening and engaging the first wall on opposing sides of the at least one first opening; and the second wide portion is disposed adjacent to the second wall and extends across the at least one second opening, such that the at least one connecting member secures the at least one second container to the first container.

2. The container system according to claim 1, wherein the at least one connecting member is at least partially insertable through the at least one second opening and the at least one first opening in a first orientation, such that the narrow portion is at least partially received within each of the at least one first opening and the at least one second opening, the first wide portion is received within the first container adjacent to the first wall, and the second wide portion is disposed adjacent to the second wall, and wherein, upon insertion, the at least one connecting member is rotatable from the first orientation to a second orientation, such that the at least one connecting member secures the at least one second container to the first container when in the second orientation.

3. The container system according to claim 2, wherein the at least one connecting member defines a connection axis extending along the narrow portion, and wherein the at least one connecting member is rotatable about the connection axis between the first orientation and the second orientation.

4. The container system according to claim 2, wherein each of the at least one first opening and the at least one second opening comprises a central opening portion and a pair of elongate opening portions extending from opposing sides of the central opening portion, the central opening portion defining the maximum width of each of the at least one first opening and the at least one second opening, wherein a width of each of the pair of elongate opening portions is less than the maximum width of the central opening portion, wherein the width of the narrow portion is less than or equal to the maximum width of the central opening portion, such that the at least one connecting member is rotatable relative to the central opening portion between the first orientation and the second orientation, and wherein the width of the narrow portion is greater than the width of each of the pair of elongate opening portions, such that the narrow portion is secured within the central opening portion.

5. The container system according to claim 4, wherein the central opening portion is generally circular, such that the maximum width corresponds to a diameter of the central opening portion, and wherein each of the pair of elongate opening portions is generally rectangular with a rounded end.

6. The container system according to claim 2, wherein each of the at least one first opening and the at least one second opening defines an opening axis along its length, wherein, in the first orientation, each of the first wide portion and the second wide portion is aligned with the opening axis, such that the first wide portion is insertable through each of the at least one first opening and the at least one second opening, and wherein, in the second orientation, at least a portion of each of the first wide portion and the second wide portion is misaligned with the opening axis.

7. The container system according to claim 6, wherein, in the first orientation, each of the first wide portion and the second wide portion is substantially parallel to the opening axis, wherein, in the second orientation, each of the first wide portion and the second wide portion is inclined to the opening axis by an inclination angle, and wherein the inclination angle is 15 degrees to 90 degrees.

8. The container system according to claim 1, wherein the first wall comprises a first major surface facing the second wall and a second major surface opposite to the first major surface, wherein the first wall comprises at least one recess disposed proximal to the at least one first opening and extending at least partially from the second major surface to the first major surface, wherein the at least one connecting member further comprises at least one end projection extending from the first wide portion towards the second wide portion, and wherein the at least one end projection is at least partially received in the at least one recess, thereby preventing rotation of the first wide portion relative to the first wall.

9. The container system according to claim 8, wherein the at least one recess comprises a pair of recesses disposed on the opposing sides of the at least one first opening, wherein the at least one end projection comprises a pair of end projections extending from corresponding opposing ends of the first wide portion towards the second wide portion, and wherein each of the pair of end projections is at least partially received in a corresponding recess from the pair of recesses.

10. The container system according to claim 1, further comprising a securing member comprising at least one notch, wherein the securing member is at least partially received between the second wide portion and the second wall, wherein the narrow portion is at least partially received within the at least one notch, and wherein the securing member engages the narrow portion, the second wide portion, and the second wall.

11. The container system according to claim 1, wherein a minimum distance between the first wide portion and the second wide portion is greater than or equal to a sum of a thickness of the first wall and a thickness of the second wall.

12. The container system according to claim 1, wherein the at least one first opening comprises a plurality of first openings spaced apart from each other, wherein the at least one second opening comprises a plurality of second openings spaced apart from each other, wherein each second opening from the plurality of second openings is aligned with a corresponding first opening from the plurality of first openings, wherein the at least one connecting member comprises a plurality of connecting members, and wherein each of the plurality of connecting members is at least partially received within a corresponding first opening from the plurality of first openings and a corresponding second opening from the second openings.

13. The container system according to claim 12, further comprising a securing member comprising a plurality of notches corresponding to the plurality of connecting members, wherein the securing member is at least partially received between the second wide portion of each of the plurality of connecting members and the second wall, wherein the narrow portion of each of the plurality of connecting members is at least partially received within a corresponding notch from the plurality of notches, and wherein the securing member engages the narrow portion and the second wide portion of each of the plurality of connecting members and the second wall.

14. The container system according to claim 1, wherein the first container further comprises at least one closing member configured to close the at least one first opening and removably attached to the first wall, and wherein the at least one closing member is removed from the at least one first opening prior to attachment with the at least one second container.

15. The container system according to claim 1, wherein the first container is in a closed configuration prior to disposing the second wall of the at least one second container adjacent to the first wall of the first container.

16. A container system comprising:

a first container comprising a first wall defining a pair of first openings therethrough;

a second container comprising a second wall disposed adjacent to the first wall, the second wall defining a pair of second openings therethrough, wherein each second opening from the pair of second openings is aligned with a corresponding first opening from the pair of first openings;

a pair of connecting members, wherein each connecting member from the pair of connecting members is at least partially received with the corresponding first opening from the pair of first openings and the corresponding second opening from the pair of second openings, each connecting member comprising a narrow portion extending between a first end and a second end opposing the first end, a first wide portion disposed at the first end of the narrow portion, and a second wide portion disposed at the second end of the narrow portion, wherein a width of the narrow portion of each connecting member is less than a width of each of the first wide portion and the second wide portion, wherein the width of the first wide portion of each connecting member is greater than a maximum width of the corresponding first opening, and wherein the width of the second wide portion of each connecting member is greater than a maximum width of the corresponding second opening; and a securing member disposed on the second wall and comprising a longitudinal portion extending at least partially along the second wall between opposing ends, a pair of end extensions extending from opposing ends of the longitudinal portion, and an intermediate extension extending from the longitudinal portion between the pair of end extensions, such that the intermediate extension, the pair of end extensions, and the longitudinal portion together define a pair of notches therebetween, wherein each of the pair of notches is aligned with the narrow portion of a corresponding connecting member from the pair of connecting members;

wherein:

the narrow portion is at least partially received within each of the corresponding first opening and the corresponding second opening;

the first wide portion is received within the first container, the first wide portion extending across the corresponding first opening and engaging the first wall on opposing sides of the corresponding first opening;

the second wide portion is disposed adjacent to the second wall and extends across the corresponding second opening;

each of the pair of notches at least partially receives therein the narrow portion of the corresponding connecting member;

each of the pair of end extensions is at least partially received between the second wide portion of the corresponding connecting member and the second wall, each of the pair of end extensions engaging the narrow portion and the second wide portion of the corresponding connecting member and the second wall; and the intermediate extension at least partially extends between the pair of connecting members and is at least partially received between the second wide portion of each connecting member and the second wall, the intermediate extension engaging the narrow portion and the second wide portion of each connecting member and the second wall, such that the pair of connecting members and the securing member secure the second container to the first container.

17. The container system according to claim 16, wherein the first wall comprises a first major surface facing the second wall and a second major surface opposite to the first major surface, wherein the first wall comprises a pair of recesses disposed on the opposing sides of each first opening and extending at least partially from the second major surface to the first major surface, wherein each connecting member further comprises a pair of end projections extending from corresponding opposing ends of the first wide portion towards the second wide portion, and wherein each of the pair of end projections is at least partially received in a corresponding recess from the pair of recesses, thereby preventing rotation of the first wide portion relative to the first wall.

* * * * *